US007216646B2

(12) United States Patent
Le et al.

(10) Patent No.: US 7,216,646 B2
(45) Date of Patent: May 15, 2007

(54) OVEN RACK WITH SLIDE ASSEMBLY

(75) Inventors: Baoloc Le, La Puente, CA (US); Quinn Chi, El Monte, CA (US); Klaus Dobberstein, Beselich (DE); Markus Geberzahn, Hadamar (DE)

(73) Assignee: Accuride International Inc., Santa Fe Springs, CA (US)

( * ) Notice: Subject to any disclaimer, the term of this patent is extended or adjusted under 35 U.S.C. 154(b) by 0 days.

(21) Appl. No.: 10/651,488

(22) Filed: Aug. 29, 2003

(65) Prior Publication Data

US 2004/0069299 A1 Apr. 15, 2004

Related U.S. Application Data

(63) Continuation-in-part of application No. 10/617,493, filed on Jul. 10, 2003.

(60) Provisional application No. 60/407,102, filed on Aug. 29, 2002, provisional application No. 60/395,204, filed on Jul. 10, 2002.

(51) Int. Cl.
*F24C 15/16* (2006.01)

(52) U.S. Cl. ..... 126/339; 126/273 R; 312/410

(58) Field of Classification Search ..... 126/339, 126/337 R, 337 A, 273 R, 19 R, 39 R, 41 R; 211/181.1; 312/410, 408, 330.1; 108/143
See application file for complete search history.

(56) References Cited

U.S. PATENT DOCUMENTS

| | | | | |
|---|---|---|---|---|
| 1,896,307 | A | 2/1933 | Hatch | 126/337 R |
| 1,918,457 | A * | 7/1933 | Yates | 248/239 |
| 2,033,859 | A | 3/1936 | Otte | 126/339 |
| 2,466,360 | A | 4/1949 | Bitney | 126/337 R |
| 2,899,255 | A * | 8/1959 | Evans | 312/274 |
| 4,651,713 | A | 3/1987 | Omdrasik, II | 126/339 |
| 6,148,813 | A | 11/2000 | Barnes et al. | 126/339 |
| 6,643,900 | B2 | 11/2003 | Jährling | |
| 6,789,861 | B1 | 9/2004 | Dobberstein | |
| 2001/0044992 | A1 | 11/2001 | Jahrling | |

FOREIGN PATENT DOCUMENTS

| | | |
|---|---|---|
| EP | 1 158 185 A2 | 11/2001 |
| EP | 1 158 185 A3 | 7/2002 |
| FR | 2 266 110 | 10/1975 |
| WO | WO 01/30162 A1 | 5/2001 |

OTHER PUBLICATIONS

International Search Report for International Application No. PCT/US03/22329 filed Jul. 10, 2003 (3 pages) mailed Jan. 2, 2004.

(Continued)

*Primary Examiner*—Josiah C. Cocks
(74) *Attorney, Agent, or Firm*—Christie, Parker & Hale LLP

(57) ABSTRACT

An oven rack assembly including full extension slides. Full extension slides are mounted to an oven rack and oven rack frames or wire racks providing full extension of an oven rack from an oven enclosure. The rack frame is mounted to oven walls or the slides are coupled to wire racks along oven slide walls.

5 Claims, 21 Drawing Sheets

OTHER PUBLICATIONS

Hettich International, "QUADRO The Ball Bearing Principle", Modern Woodworking, Feb. 2002 (p. 8).

USPTO IFW materials for US 6,789,861 B1 (57 pgs).

Amendment filed in U.S. Appl. No. 10/617,493, filed Jul. 10, 2003, amendment dated Dec. 3, 2004 (14 pgs.).

U.S. Appl. No. 10/617,493, filed Jul. 10, 2003, entitled Oven Assembly With Slides, Inventors: Baoloc Le, Quinn Chi; Klaus Dobberstein, Markus Geberzahn, including Specification and Claims (32 pgs); Informal Drawings (35 pgs).

International Search Report dated Feb. 18, 2004 for International Application No. PCT/US03/27026 filed Aug. 29, 2003, mailed Mar. 12, 2004 (4 pages).

Office action mailed Sep. 3, 2004 for U.S. Appl. No. 10/617,493, filed Jul. 10, 2003 (8 pgs.).

Office Action for U.S. Appl. No. 10/617,493, filed Jul. 10, 2003, inventor Baoloc Le, Office Action mailed Mar. 4, 2005 (11 pgs.).

* cited by examiner

OVEN RACK WITH SLIDE ASSEMBLY

CROSS REFERENCE TO RELATED APPLICATION

This application claims the benefit of U.S. Provisional Application No. 60/407,102, filed Aug. 29, 2002 and is a continuation-in-part of U.S. patent application Ser. No. 10/617,493, filed Jul. 10, 2003, entitled Oven Assembly With Slides, which claims the benefit of U.S. Provisional Application No. 60/395,204, filed Jul. 10, 2002 and U.S. Provisional Application No. 60/407,102, filed Aug. 29, 2002, all of which are hereby incorporated by reference as if set forth in full herein.

BACKGROUND OF THE INVENTION

The present invention relates generally to ovens, and more particularly to extendable rack assemblies for ovens.

Ovens often have one or more racks generally within the oven. The racks are useful for the placing of cookware, food, and other items, within the oven. The racks place the cookware generally towards the middle of the oven, and keep the cookware away from heating elements and the like. In addition, ovens with multiple racks allow for placement of cookware on a variety of levels within the oven, thereby increasing the total volume of available cooking space.

The racks are often supported by ledges formed along the walls of the oven. The racks are then movable in and out of the oven on the ledges. This allows the racks to be removed from the oven for cleaning or for other purposes. Often, the racks may be partially removed from the oven so as to allow easier access to items placed on the racks.

Movement of the racks on the ledges, or through other friction mechanisms, may not always provide smooth and relatively effortless motion. Unconformities in the ledges or friction mechanisms may interfere with motion of a rack. Similarly, food or other items may become lodged in a rack pathway, increasing the difficulty in movement of the rack.

In addition, the racks often may not be extended very far from the oven, particularly when heavy items are placed on the rack. Since the racks must still be supported by the ledges of the oven, over extension of the rack may lead to disastrous results, with the rack and its contents dropping to perhaps the floor. Moreover, the items on the rack may be difficult to view or handle if the rack is partially in the oven. This increases the chances of burns occurring to users of the oven through contact with other racks or the side walls of the oven. Further, at times lateral stability of a rack, particularly when a rack is extended from the oven, may be important.

Moreover, in some environments it is useful to temporarily lock a rack in some predefined position, whether within or outside the oven. For example, in some instances it may be useful to temporarily lock a rack in an extended position while items are placed on the rack. Similarly, securely positioning the rack within the oven during cooking or otherwise may also be useful.

BRIEF SUMMARY OF THE INVENTION

The invention provides an oven with an extendable rack. In one embodiment the rack is fully extendable from the oven. In one embodiment this is accomplished through the use of a full extension slide provided on a rack frame resting on ledges of the oven, with a rack coupled to the full extension slide. In one aspect, the invention provides an extendable oven rack assembly comprising an oven rack adapted for positioning in an oven cavity; two full extension slides, one each coupled to opposing margins of the oven rack, with the slides adapted for positioning approximate opposing side walls of the oven cavity and the slides providing extension of the oven rack from a position entirely within the oven cavity to a position outside the oven cavity.

One aspect of the invention provides an oven assembly with an extendable rack, comprising an oven rack including a pair of laterally spaced subtending bars, the subtending bars including two mounting points; and a pair of extendable slide assemblies, each slide assembly coupled to a corresponding subtending bar at the two mounting points.

Another aspect of the invention provides an oven assembly with an extendable rack, comprising an oven rack including an oven rack support surface adapted to have placed thereon items for cooking in an oven, with a pair of longitudinal mounting bars approximate edges of the oven rack support surface, the longitudinal mounting bars including at least two mounting points; and two slides, one each coupled to a corresponding mounting bar at the mounting points.

Another aspect of the invention provides an oven rack adapted for use in an oven rack assembly including slides, the oven rack comprising a forward bar; a rear bar; side bars interconnecting the forward bar and the rear bar; a plurality of bars forming an oven rack support surface; and a pair of mounting bars, each including two mounting points, substantially parallel to the side bars and below the oven rack support surface.

These and other aspects of the invention are more fully comprehended on review of the following in view of the accompanying figures.

DETAILED DESCRIPTION

Figure 1:
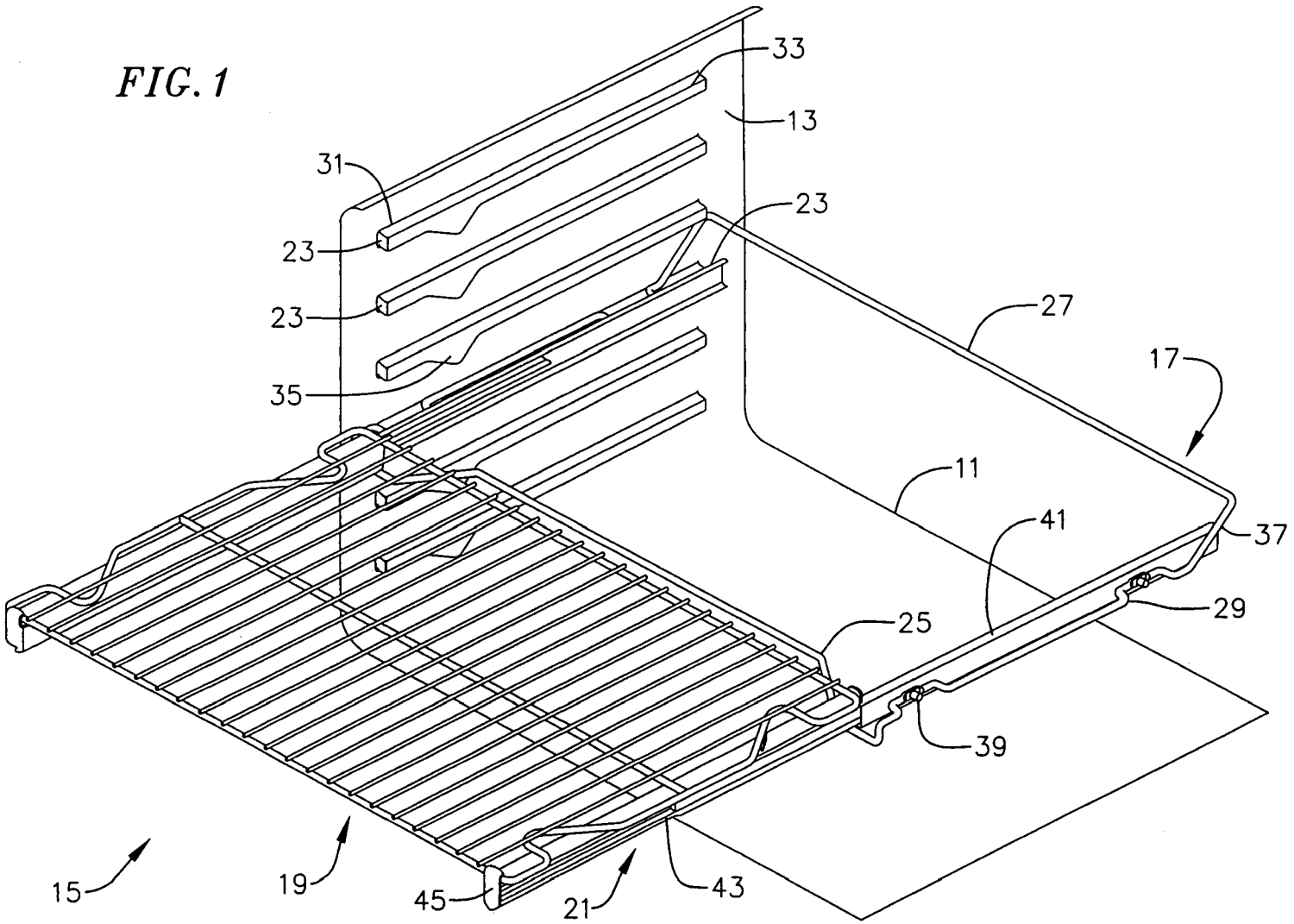
FIG. 1 illustrates a partial view of an oven with a rack assembly of the present invention.

FIG. 1 illustrates a partial view of an oven. As illustrated, the oven includes a base 11 and a side wall 13. Not specifically illustrated, but known to many, is a back wall of the oven, a roof of the oven, an opposing side wall opposing the side wall illustrated, and a door across the front of the oven. These elements of the oven are not specifically illustrated, although known, so as to allow further view of a rack assembly 15 used in the oven. The rack assembly includes a rack frame 17 supported within the oven, a rack 19 to support cookware, and extendable slides 21 interconnecting the rack and the rack frame. In use the rack frame remains seated within the oven, and the rack may be extended from the oven using the extendable slides.

In the oven of FIG. 1, the rack frame rests on ledges 23 on the oven sidewalls. The rack frame forms a substantially rectangular shape of tubular metal, with a front bar 25, a rear bar 27, and side bars 29 connecting the front and rear bars at their ends.

Figure 2:
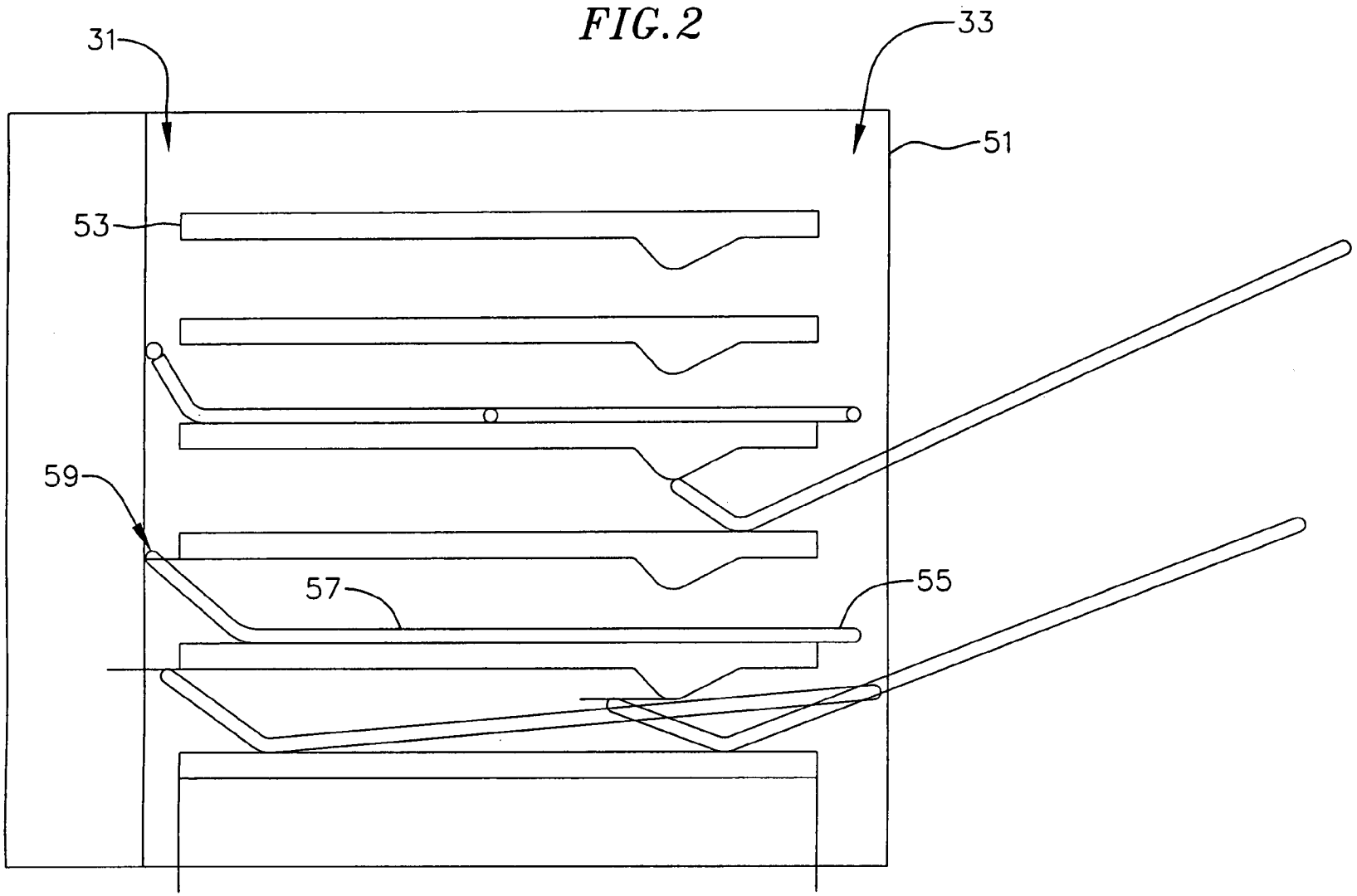
FIG. 2 illustrates a side view of an oven wall and rack frame resting on a ledge of the oven wall.

The side bars rest upon ledges formed on the side walls of the oven. In the oven of FIG. 2, twelve ledges are provided, with six ledges on the illustrated side wall and six ledges on the not shown opposing side wall. The corresponding ledges on the two sidewalls are at substantially the same height, with each of corresponding ledges providing a substantially flat surface which may support an object which extends from one side wall of the oven to the other. As illustrated, the ledges substantially cross the length of the oven, with gaps 31, 33, as may be seen in FIGS. 1 and 2, towards the front of the oven and towards the rear of the oven. The underside of each of the ledges also includes, towards the front of the ledges, a downward protrusion 35. The downward protrusion is used in some ovens so as to stop forward movement of a rack in the oven.

As illustrated in FIG. 1, a ramped portion 37 is formed along rear ends of the side bars of the rack frame. Thus, the rear bar of the rack frame is elevated somewhat with respect to the front bar of the rack frame when the side bars rest on the ledges. The rear bar is elevated an amount sufficient to have its forward movement obstructed by another ledge in the series of ledges on the oven side walls.

FIG. 2 more fully illustrates this aspect, and other aspects, of the rack frame and the ledges of the oven side wall. FIG. 2 is a side view illustrating an oven side wall 51, ledges on the oven side wall 53, and a rack frame 55. As illustrated, a first distance separates each ledge of the ledges of the side wall. Side bars 57 of the rack frame largely rest on the ledges. The side bars are angled upwards towards the rear of the side bars. The result is a rear bar 59 of the rack frame is in an elevated position. The side bars are angled sufficiently such that the rear bar of the rack frame is elevated at a greater amount than the distance separating the ledges. Thus, the rear bar may be suitably placed into the gap between the ledges and a rear wall of the oven such that forward motion of the rear bar is obstructed by a ledge. In the embodiment illustrated, the side bars are angled approximately 40 degrees from the horizontal.

In addition, the relative position of the ledges on the oven side wall and the rear bar of the rack frame serve to prevent undue angular motion of the rack assembly, particularly when the rack is extended from the oven and forms a lever arm with respect to the rack frame. Further, in the event of changes to oven cavity designs, modification of the rack frame design may be accomplished without necessarily significant changes to other components of the rack assembly.

Returning to FIG. 1, the side bars of the rack frame include a mounting feature 39 allowing mounting of the side bars to a web 41 of the drawer slide. In one embodiment the mounting feature is a hole placed through the side bars allowing a screw, a bolt, a rivet, or other mounting feature to be attached through the rack frame and into a web of a slide member. In other embodiments other mounting methods are used. As will be described in somewhat more detail, a flange can be welded or otherwise attached to the rack frame, such that the flange extends upwards of the rack frame and a slide member mounted to the flange.

Figure 3:
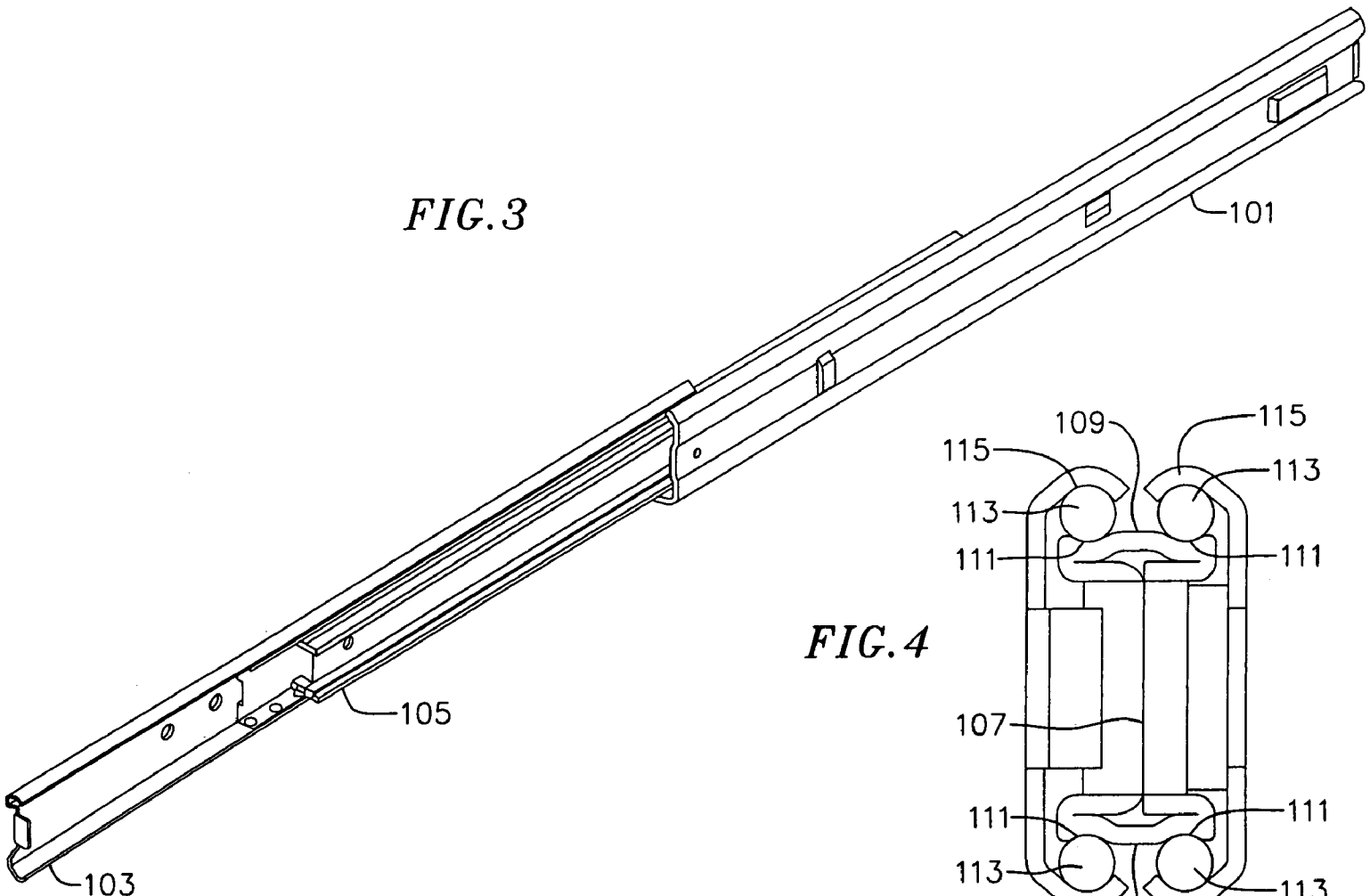
FIG. 3 is a perspective view of a side-by-side slide used in an embodiment of the rack assembly.
Figure 4:
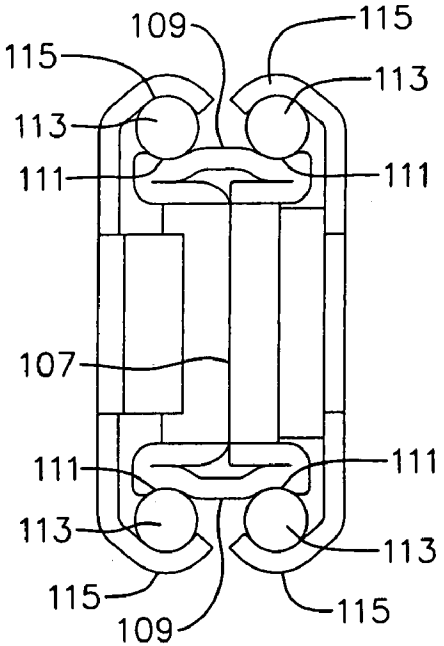
FIG. 4 is a cross-section of the side-by-side slide of FIG. 3.

FIG. 3 illustrates a perspective view of a full extension slide used in some embodiments of the invention. As illustrated, the slide of FIG. 4 is a side-by-side slide. The side-by-side slide, sometimes also called a parallel slide, often, and as illustrated, includes two outer members 101, 103 with generally C-shaped cross-sections, with the members arranged so that the C-shaped cross-sections oppose each other. Between the two generally C-shaped cross-sections is a somewhat I-shaped inner member 105. In operation, the outer members extend in opposing directions from the inner member, with the outer members and the inner member connected by way of bearings riding in bearing raceways.

FIG. 4 illustrates a cross-section of the slide of FIG. 3. As illustrated, the inner member is a substantially I-shaped member. The inner member may be formed, for example, by bonding two somewhat C-shaped members together along their webs. In the example illustrated in FIG. 4, however, the inner member is a roll formed I-shaped member. The I-shaped member includes a central web 107, with cross pieces 109 on the top and the bottom of the web. The cross pieces include bearing raceways 111 along either side of the web. Bearings 113 ride in the bearing raceways and rollably couple the inner member to the outer members. Thus, the outer members also include bearing raceways 115 formed along the length of webs of the outer members, with the bearings riding in the bearing raceways of the outer and inner members.

Returning to FIG. 1, and taking a first drawer slide as an example, the side edges of the rack frame are fixed to a web of a first outer member. Accordingly, the first outer member is fixed to the rack frame, with the rack frame within the oven. The inner member extends from the first outer member, and is illustrated as being extended from the first outer member towards the front of the oven. A second outer member extends from the inner member with the second outer member substantially fully out of the oven. Thus, as in the instant case, the term full extension when used with respected slide refers to the ability of a portion of the slide, namely a slide member, to extend substantially completely out of an enclosure.

A rack is coupled, in some embodiments by way of a mounting accessory discussed later, to the second outer member. Thus, the rack may be extended substantially out of the oven. Moreover, the rack is stably supported by the slides.

Turning now to the rack, FIG. 20, discussed further later, illustrates a rack adapted for use with the present invention. The rack comprises a forward bar 151, a rear bar 153, and side bars 155 interconnecting the forward and rear edges. Support bars 157 placed at regular intervals interconnect the two side bars. Rack bars 159 are placed from a front edge to a rear edge, with the spacing of the rack bars adapted for placement of items on the rack. The support bar provides additional support for the rack bars.

Figure 5:
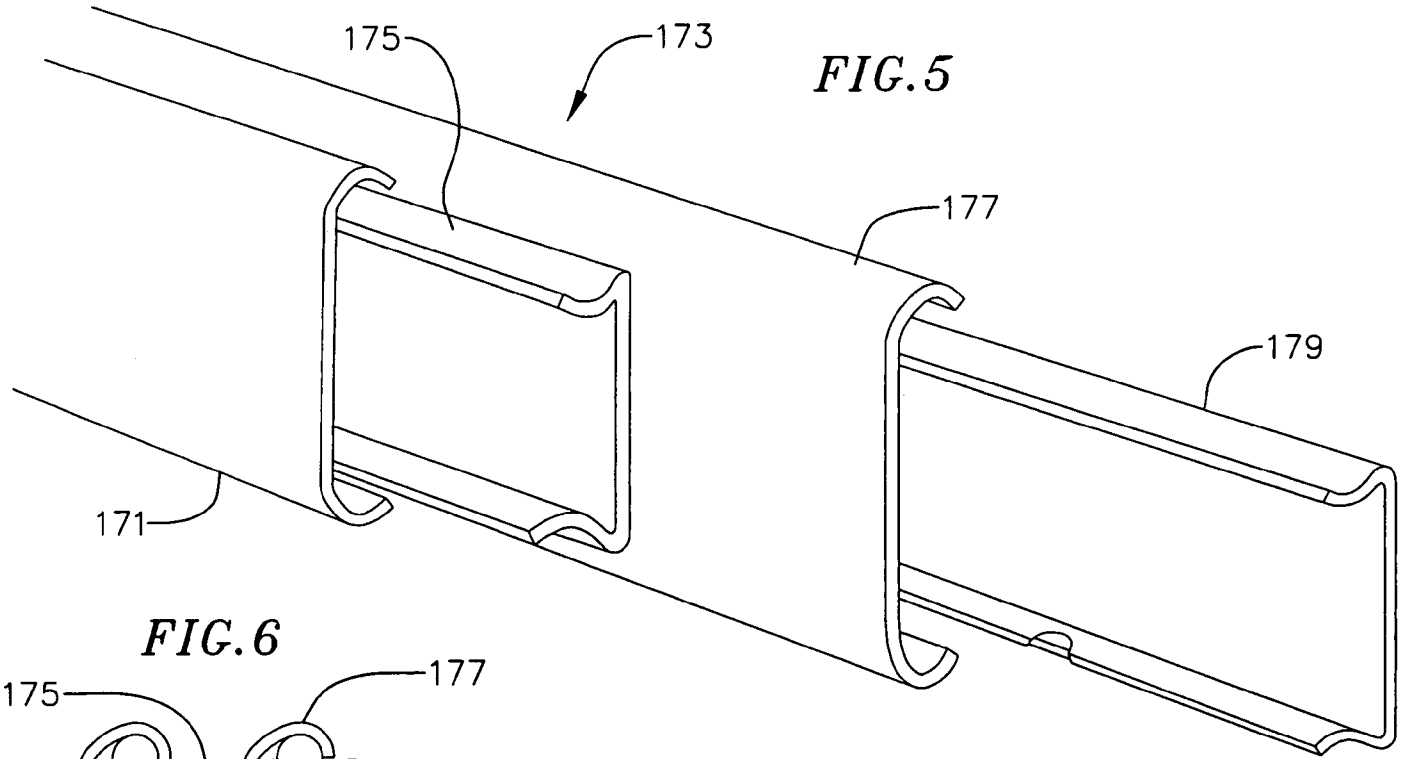
FIG. 5 is a perspective view of an alternative slide used in embodiments of the invention.

FIG. 5 illustrates a perspective view of an alternative slide used in embodiments of the invention. The alternative slide is a hybrid parallel and telescopic slide. As illustrated, the hybrid slide is a full extension slide, with three slide members. A first slide member 171 is substantially C-shaped with a planar web and bearing raceways along the length of the planar web. A second slide member 173, which may also be called an intermediate slide member, includes a first C-shaped section and a second C-shaped section 177. The two C-shaped sections face away from each other, and are coupled together through welding or embossing or the like.

For the second, or intermediate, slide member, the first C-shaped section 175 is of reduced dimension compared to the second C-shaped section 177. The first C-shaped section is dimensioned adapted to fit within the C-shaped section of the first slide member. Bearings riding in the bearing raceways of the section and the slide member couple the slide members together in a slidable, or rollable, fashion.

A third slide member 179 is coupled to the second C-shaped section of the intermediate slide member by bearings. The third slide member is dimensioned to fit within the second C-shaped section of the intermediate slide member. Accordingly, the alternative slide has features of a parallel, or side-by-side, slide, yet also has features of a telescopic slide.

Figure 6:
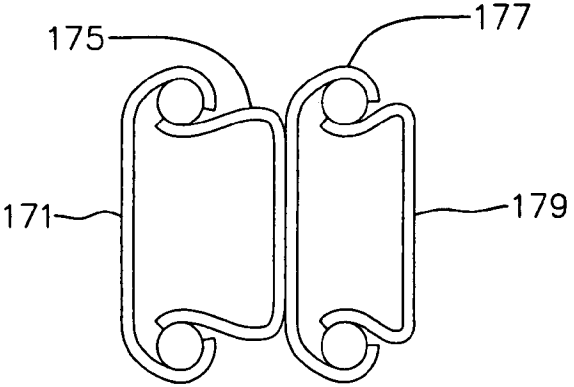
FIG. 6 is a cross-section of the slide of FIG. 5.

As can be seen in the cross-sectional view of FIG. 6, the alternative slide includes four major components. The four major components are the first slide member 171, the first C-shaped section of the second slide member 175, the second C-shaped section of the second slide member 177, and the third slide member 179, which may be termed first, second, third and fourth components, respectively. As illustrated, and providing conveniences in manufacture, the first and third components are similarly dimensioned, as are the second and fourth components.

Conveniently, in some embodiments the assembly of the present invention includes features providing for maintenance of the rack at a position within the oven, at a position of intermediate extension from the oven, and at a position fully extended from the oven. Such a feature is convenient in that inadvertent movement of the rack from positions at which items on the rack are commonly handled may be inconvenient. In addition, the features allow for improved sequencing of the drawer slide to avoid bearing drift and uneven load distribution. These features are sometimes termed detent features, with a detent providing a frictional interface, either in one direction, an opposing direction, or both directions, with the frictional interface requiring an increased force to allow for movement of the slide.

Figure 7:
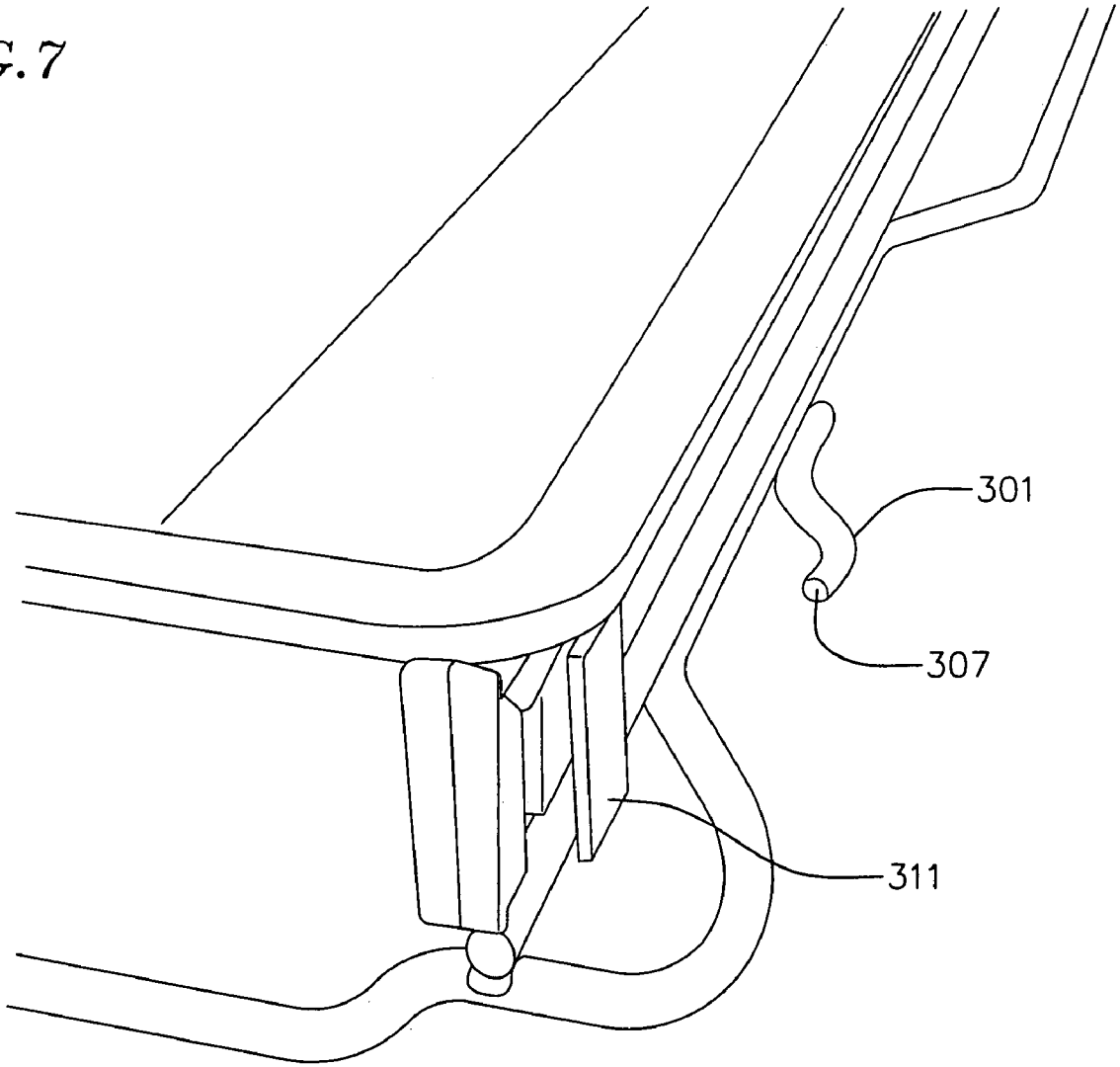
FIG. 7 illustrates an oven and rack assembly using a holding tab useful in some embodiments of the invention.

In the embodiment of FIG. 1 retention of the rack frame within the oven was accomplished through use of angled side bars such that the rear bar contacts another ledge. The contact of the rear bar and the end of another ledge prevents forward motion of the rack frame. Removal of the rack frame from the oven in such an embodiment is accomplished by tilting the assembly such that the rear bar no longer contacts another ledge. FIG. 7 illustrates an embodiment in which tilting of the assembly is not used to remove the rack frame from the oven. Instead a tab extends from the rack frame. The tab is adapted to contact a downward protrusion near the front of the bottom of another ledge. Contact of the tab and the protrusion from the ledge prevents forward movement of the rack frame. The tab, however, extends at an angle from the rack frame and somewhat provides a spring effect, with the tab forming a leaf spring. The application of increased force in pulling the assembly from the oven results in the tab bending and passing past the protrusion on the ledge. In such a manner the rack then may be removed from the oven.

Figure 8:
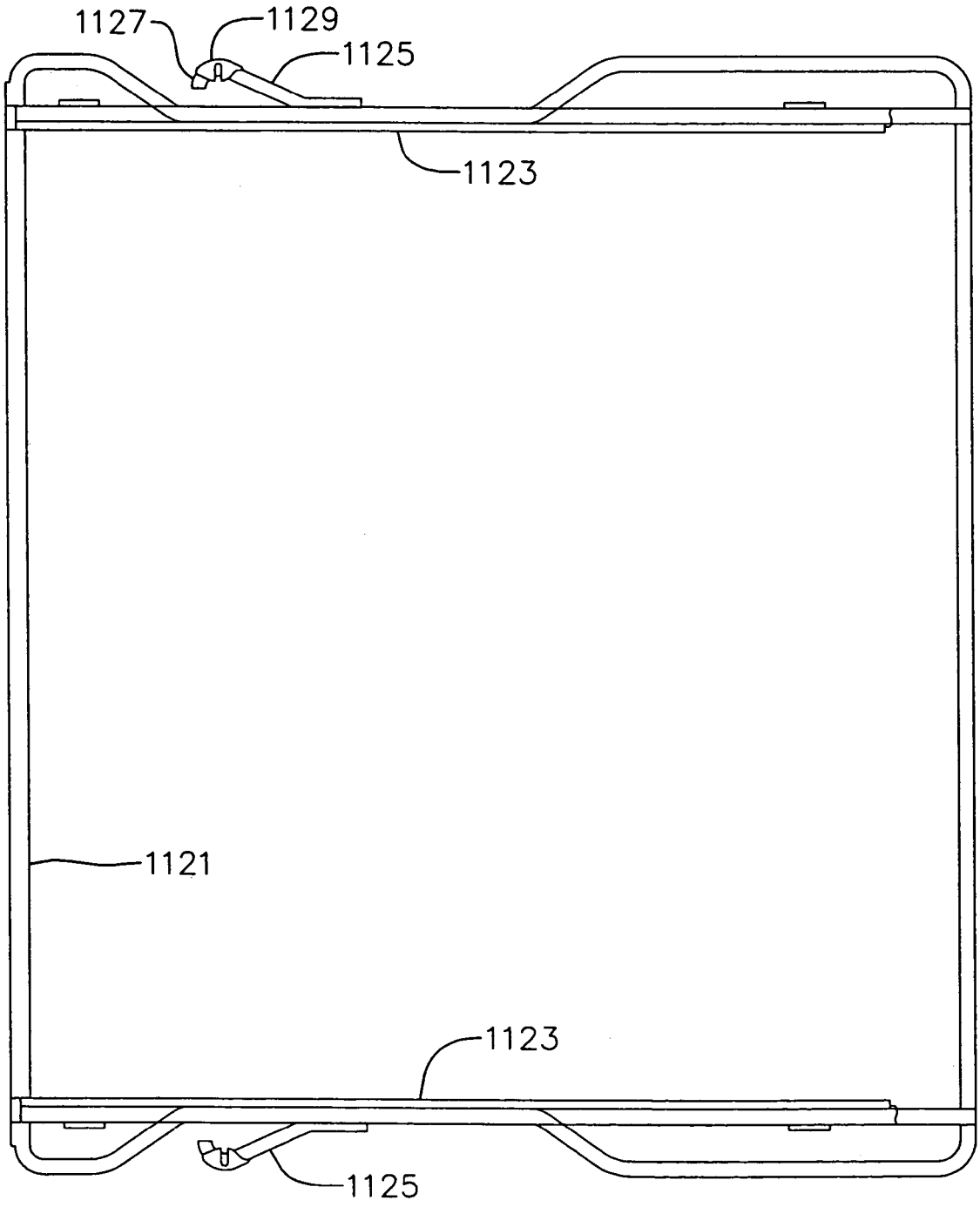
FIG. 8 is a top view of the rack frame and slide assembly of FIG. 7.

FIG. 8 is a top view of the rack frame and slide assembly of FIG. 7. Thus, the rack frame and slide assembly includes a rack frame 1121 and attached slides 1123. Also included are tabs 1125 extending from the wire frame. The tabs serve as a leaf spring pressing against side walls of an oven enclosure (not shown). In the embodiment of FIG. 8, an outward edge 1127 of the tab includes a plastic insert 1129. The plastic insert mounts about the leading edge of the tab approximate the oven wall enclosure. The plastic insert, which in some embodiments is a high temperature plastic, provides a cushioning effect so as not to scratch the walls of the oven enclosure.

Figure 9:
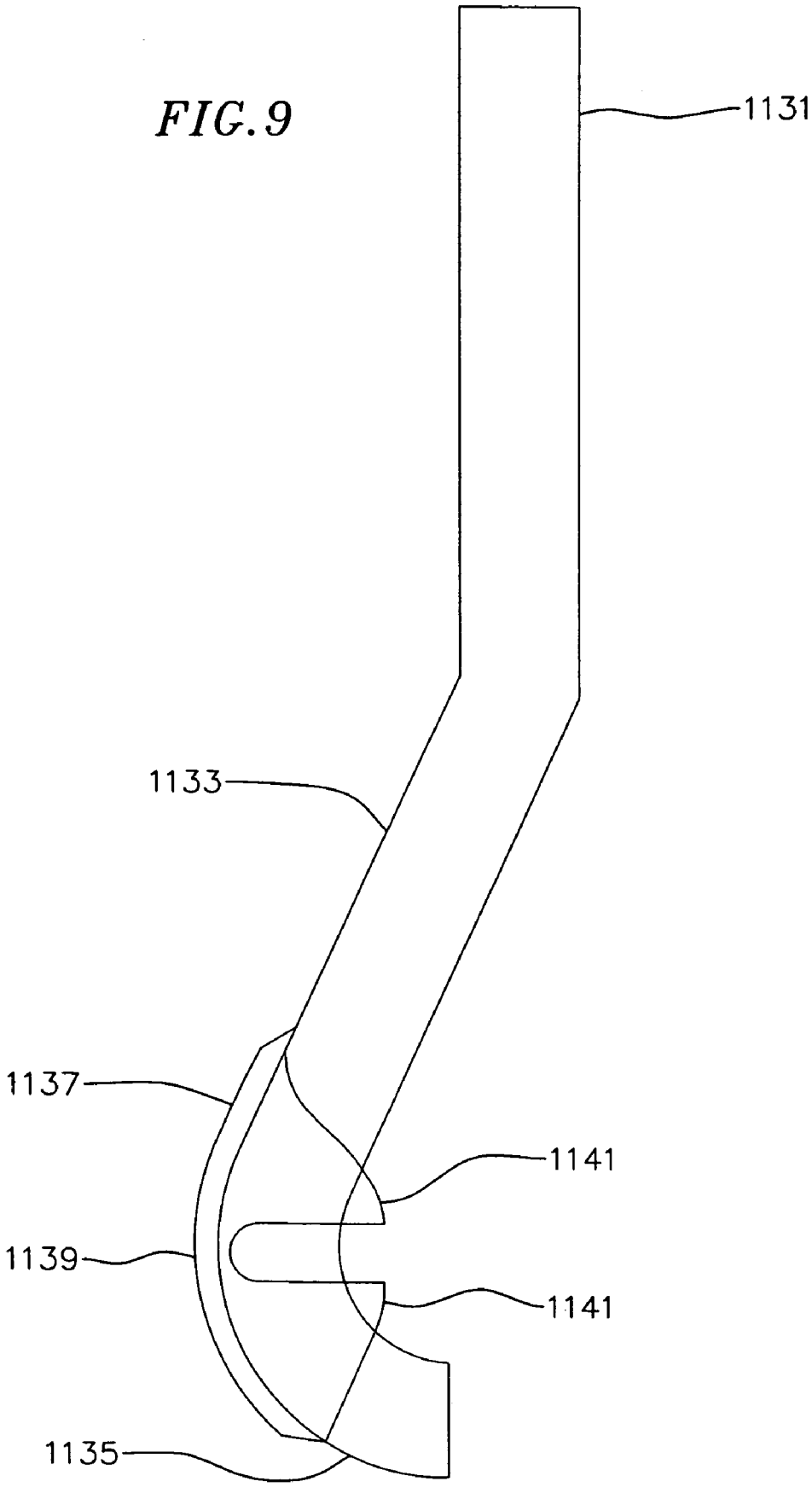
FIG. 9 is a further view of the tab and plastic insert of FIG. 8.

FIG. 9 is a further view of the tab and plastic insert of FIG. 8. As illustrated in FIG. 9, the tab includes a first linear portion 1131 adapted for welding or the like to a rack frame. An extending portion 1133 with a rounded leading edge 1135 provides a leaf spring effect. About the rounded leading edge is a plastic clip. The plastic clip includes a arc-shaped surface configured to snuggly fit against the rounded leading edge of the tab. Two gripping clips 1141 extend from the arc, and are adapted to grip the leading edge of the tab.

Figure 10:
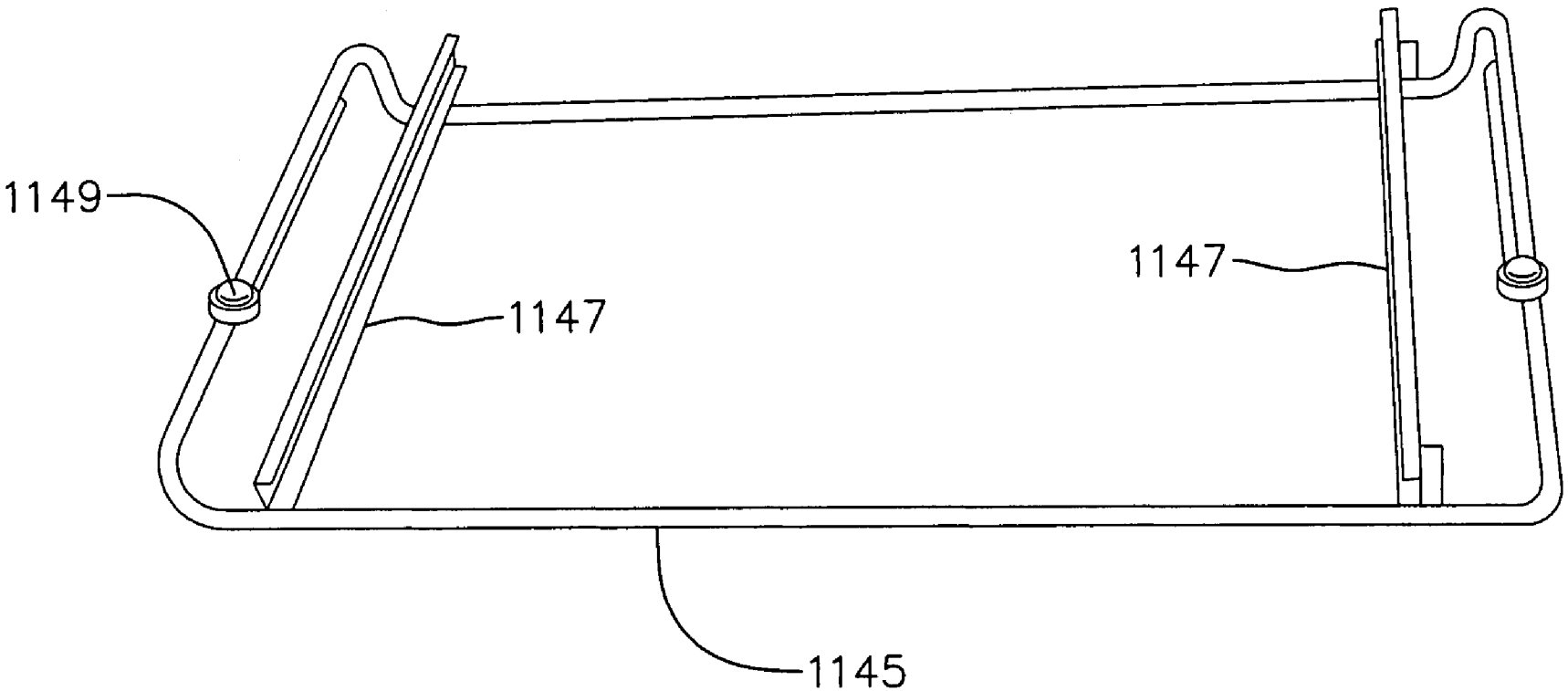
FIG. 10 illustrates a further extendable rack frame.

FIG. 10 illustrates a further extendable rack frame for mounting in an oven using ledges along the oven sidewalls. The assembly of FIG. 10 includes a wire rack frame 1145 with coupled slides. A wire rack (not shown) for the placement of food stuffs and the like would be mounted to the slides. A roller 1147 is mounted to opposing edges of the rack frame. The roller is rotateable such that as the rack frame is inserted into the oven enclosure the roller rolls against the side walls of the oven enclosure. The material of the roller is preferably a high temperature plastic, such as PEEK. The roller is of particular utility if the side ledges of the oven wall include end-stop stampings which provide a frictional interface, or detent, for stable position of the rollers in the end stops. This allows extension of the frame coupled to the slides to extend from the oven enclosure without movement of the rack frame.

Figure 11:
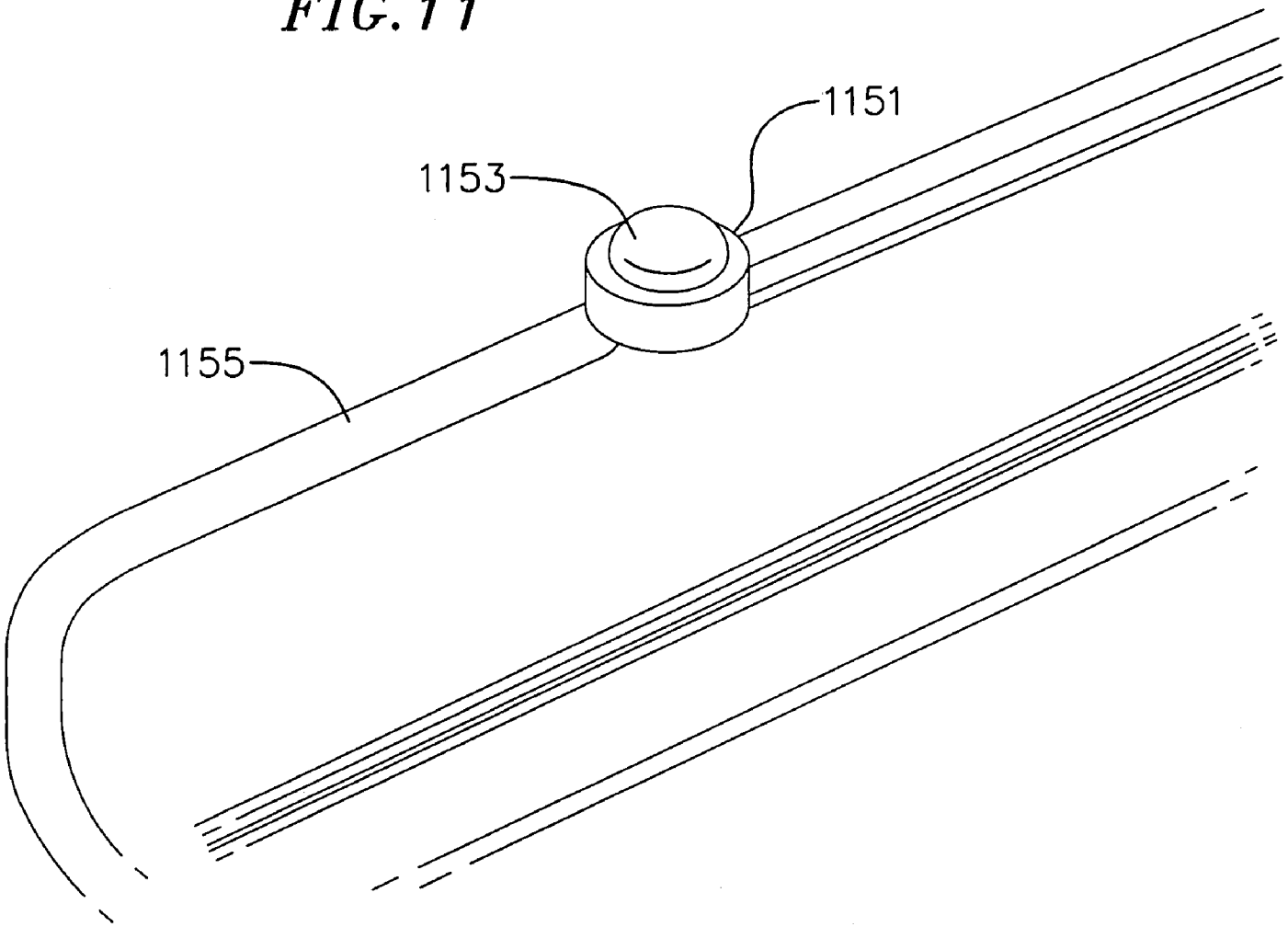
FIG. 11 show a further view of a roller of FIG. 10.

FIG. 11 shows a further view of the roller 1151. The roller is mounted to a post 1153 attached to the rack frame 1155, with the post extending virtually from the rack frames. The roller is mounted horizontally about the post.

Figure 12:
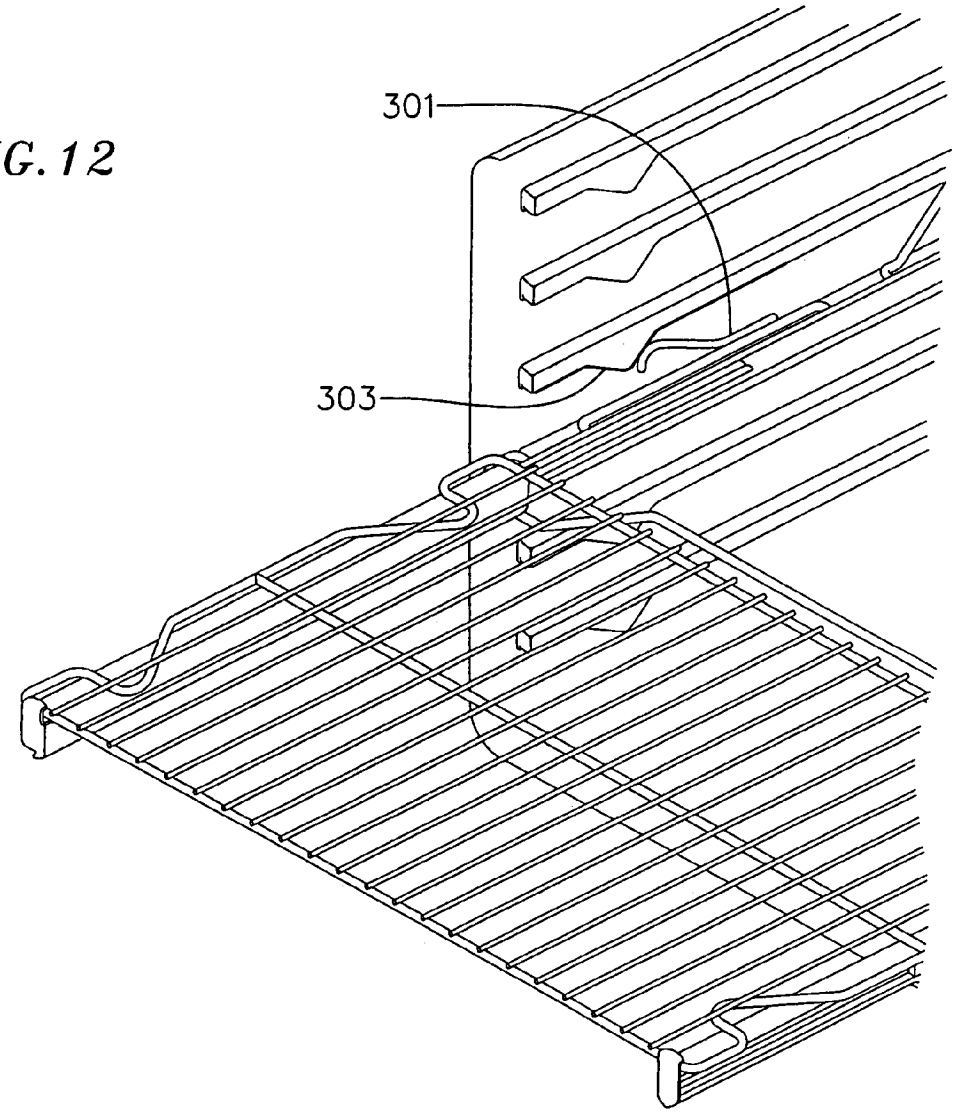
FIG. 12 illustrates a rack frame with the holding tab of FIG. 7 in some embodiments of the present invention.

FIG. 12 illustrates a tab extending from the rack. In the rack of FIG. 12, the rack includes forward and rearward portions adapted to rest on a ledge. An intermediate portion of the side bar is at an inset. A bar is attached to the inset, with one end of the bar extending away from the inset and forming a leaf spring. The forward edge of the leaf spring is angled back towards the rack frame. In operation, the angled portion contacts a protrusion from the ledge of the oven. Application of force, either in insertion into the oven or extraction from the oven, results in flexing of the tab and the frame passing by the ledge.

Also indicated in FIG. 12 is an alternative method of mounting a rack frame to a slide. In the embodiment of FIG. 12, a flange is affixed to a portion of the rack frame. The flange extends upward from a plane formed by the rack frame. The upwardly extending portion of the flange is affixed to a web of a drawer slide.

Figure 13:
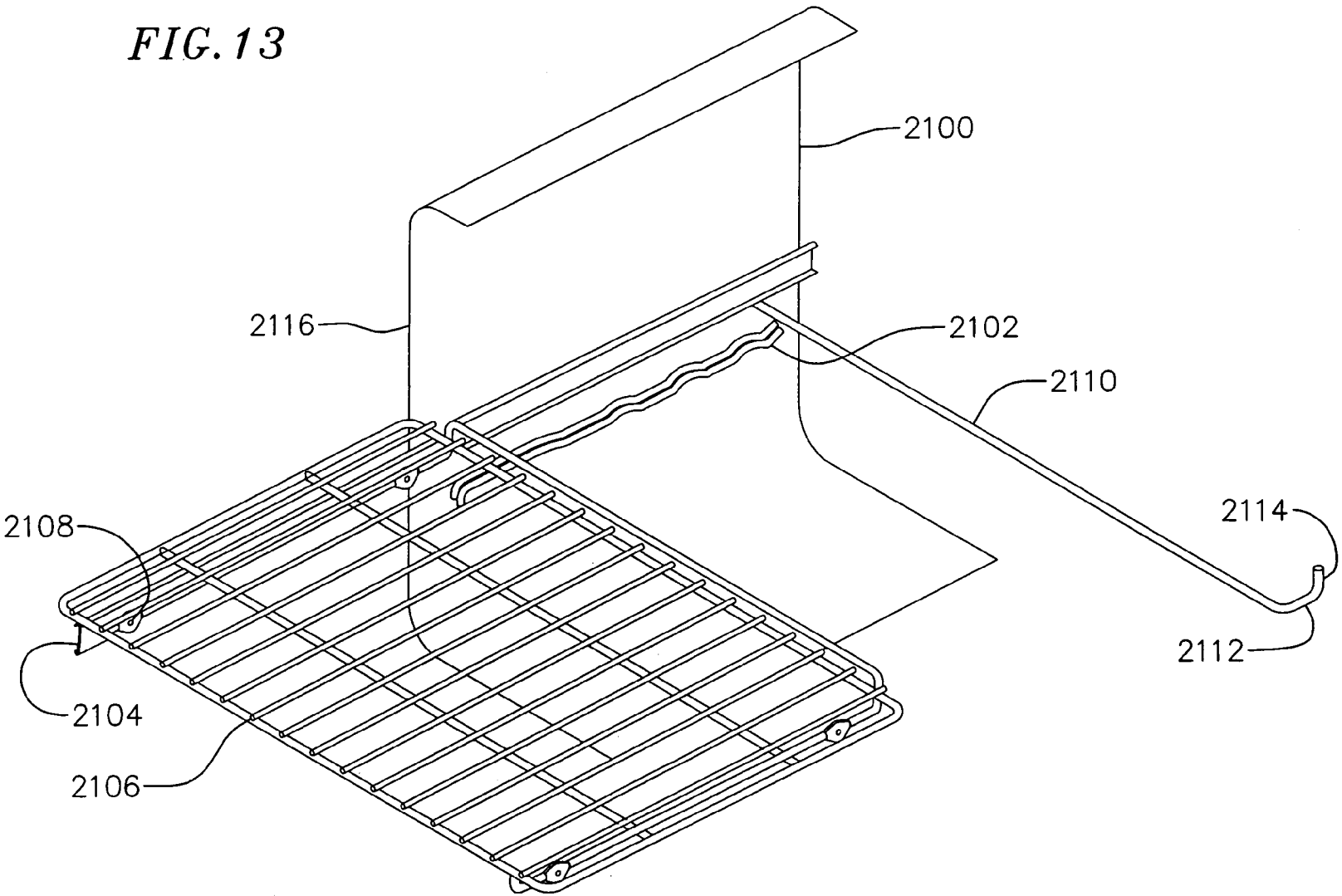
FIG. 13 illustrates a view of an alternative slide mount system used in an oven.

FIG. 13 illustrates a cut-away view of a further oven including an extendible rack in accordance with aspects of the invention. The oven includes an oven cavity with a ledge 2102 on the sidewall of the oven cavity. As in other embodiments, slides 2104 are coupled to the ledge. The slides support an oven rack 2106 attached to the slides by way of a screw 2108 rivet or a weld, with the rack extendable from the oven cavity using the slides. A rear support bar 2110 is attached, through welding for example, to the web of the rear of the slide.

The rear support bar is symmetrical, with aspects of the bar away from the illustrated slide shown in FIG. 13 to allow for increased ease of understanding. As shown in FIG. 13, the bar includes a horizontal portion 2112 extending towards the rear of the oven cavity. The horizontal portion is adapted to rest underneath the ledge, preventing the rear bar from moving upwards when the rack is extended. An end of the bar 2114 is bent upwards. The end of the bar is adapted to wrap around the back of the ledge and restrict forward movement of the bar. The end of the bar is also welded to the web of the slide member. The end of the bar therefore prevents undesired extraction of the slide from the oven cavity. By tilting upward the forward edge of the slide, however, the end of the bar may be displaced so as to clear the ledge and allow for removal of the slide from the oven cavity.

The slide is supported on the ledge by a forward bar 2116. The forward bar is welded to a portion of the outer slide member web. The bar is welded in horizontal position along the length of the web. The bar includes a downward facing leading edge, which is adapted to contact a front of the ledge of the oven cavity when the bar is resting on the ledge. The bar extends approximately halfway along the length of the slide member.

Figure 14:
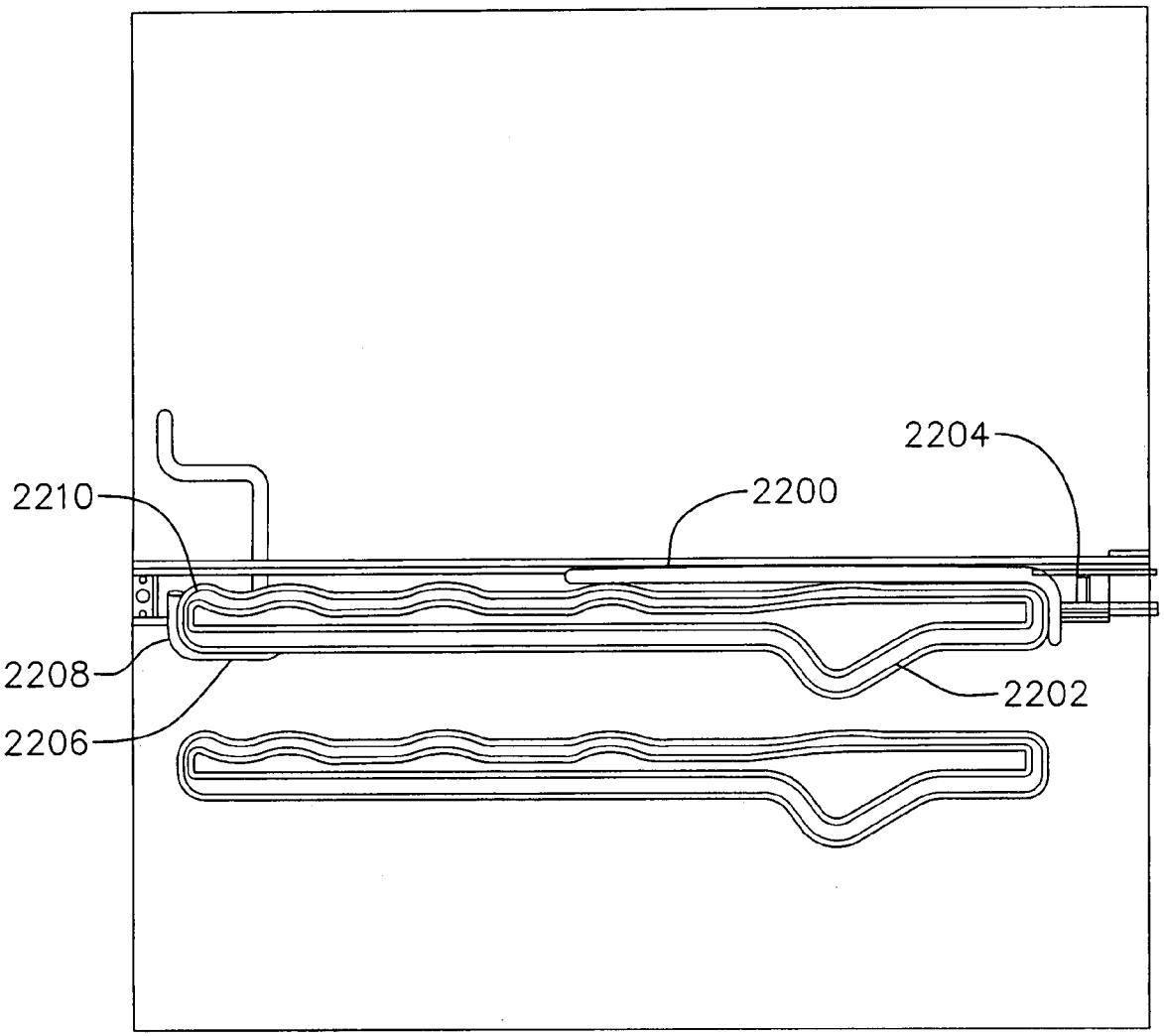
FIG. 14 illustrates a further view of mounting rods used to mount a slide in an oven cavity.

The interaction between the rear bar and the forward bar and the ledge of the oven cavity may be seen more clearly in FIG. 14. FIG. 14, a side view of the oven cavity is provided with the oven walls illustrated as translucent. As may be seen in FIG. 14, a forward bar 2200 rests on the top of a ledge 2202. The forward bar is attached to the web of the slide member 2204. The forward bar extends substantially along the length of the slide member and provides vertical support for the slide. A leading edge of the forward bar wraps around the front of the oven ledge, preventing further rear movement of the slide.

A rear bar contains a horizontal portion 2206. The horizontal portion rests underneath the oven ledge and is adapted to contact the rear of the oven ledge 2210. An upwardly bent portion 2208 wraps around the rear of the oven ledge. The upwardly bent portion prevents the slide member from being pulled out of the oven when the slide is extended. However, if the front of the slide is tilted upward, the upwardly bent portion is able to pass underneath the ledge and allow for removal of the slide.

The connecting bar which connects the opposing sides of the portions adapted to contact the oven ledges provides for increased lateral support for the structure as a whole. As the rear bar is substantially the width of the oven cavity, the rear of the slide and the portions of the bar which interacts with the ledge are maintained in position along the ledge, and do not flex inwards away from the ledge.

Figure 15:
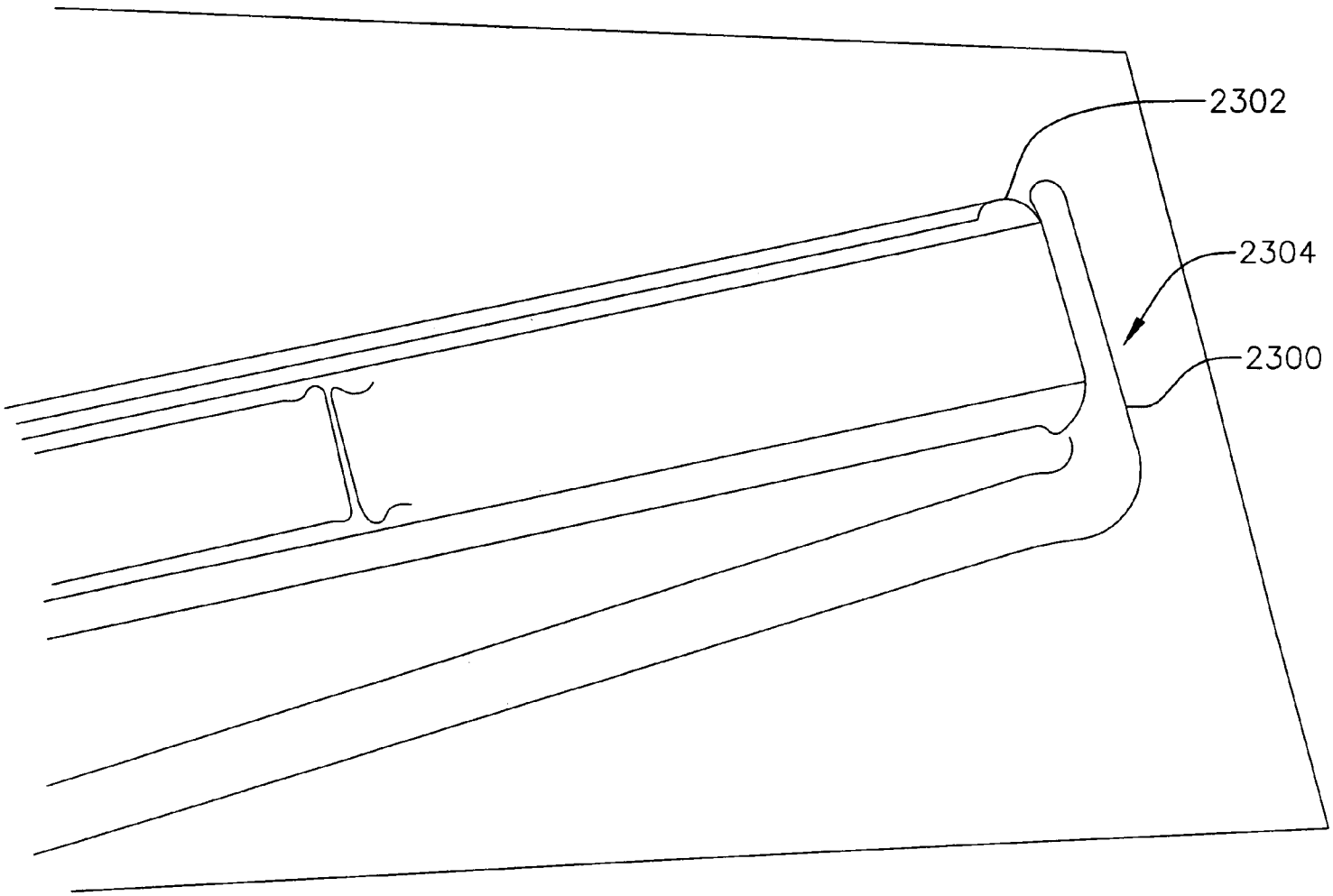
FIG. 15 illustrates a further view of the mounting bars of FIG. 14.

FIG. 15 shows further detail of the portion of the rear bar and the slide. As can be seen in FIG. 15, an upwardly bent portion of the rear bar 2300 is mounted to a web of a slide member 2302. A portion of the bar also is in contact with a rear edge of an oven ledge 2304.

Figure 16:
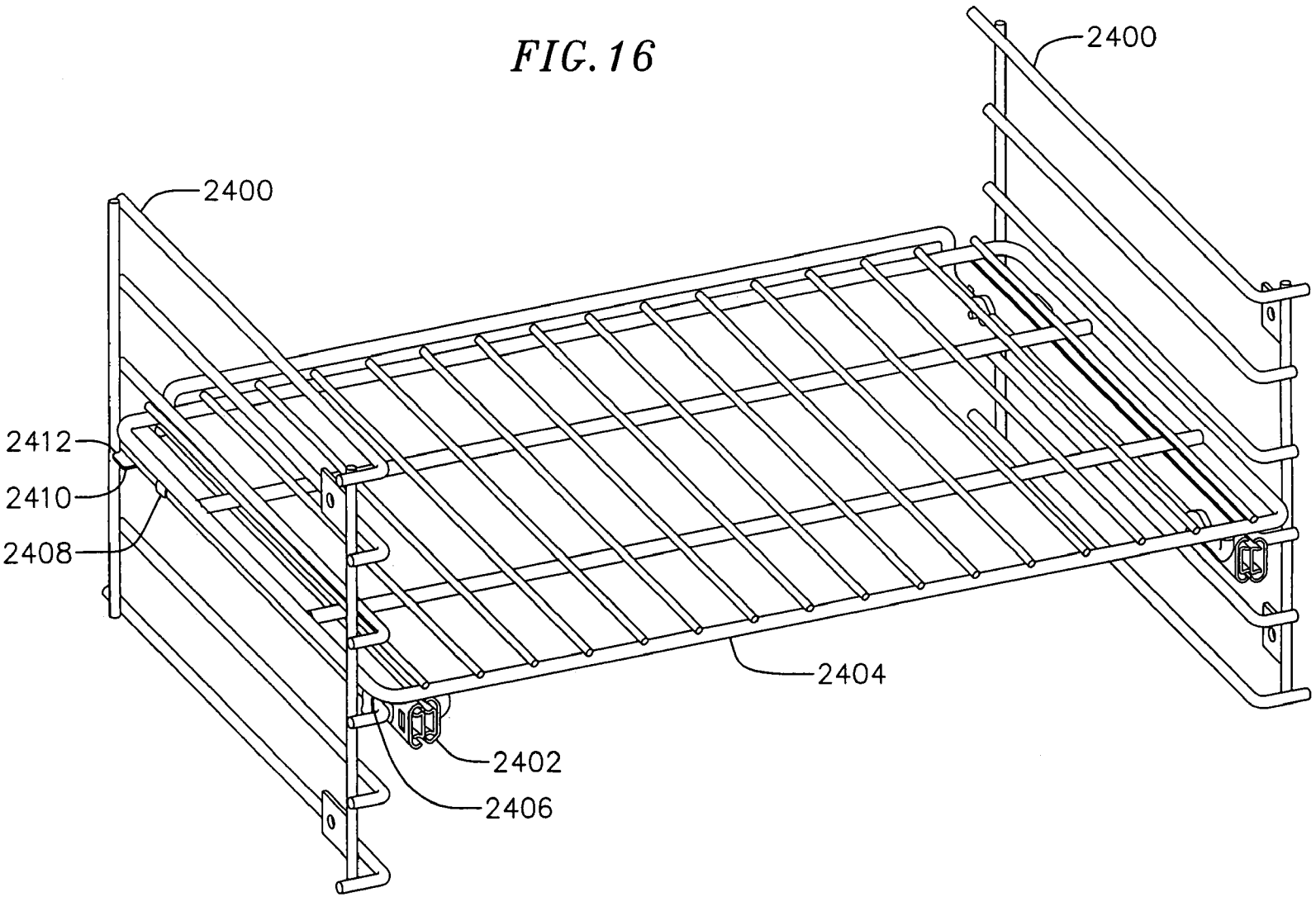
FIG. 16 illustrates an oven rack mounted to a wire frame using slides.

FIG. 16 illustrates an alternative extendable oven rack coupled to a wire frame. Some ovens use wire frames within the oven cavity to support racks and other similar fixtures. The wire frames may be used for a variety of reasons, including maintenance of a smooth or somewhat smooth cavity wall for airflow purposes and the like. As illustrated in FIG. 24, wire frames 2400 support opposing edges of an oven rack 2404. The wire frames include opposing parallel vertical posts coupled by cross-bars. The wire frames are adapted to be mounted to opposing side walls of an oven cavity, with the oven rack bridging the distance between the two wire frames.

Slides 2402 couple the oven rack to the wire frames. As illustrated, the slides are a side-by-side slide. The oven rack may, for example, have opposing sides each welded to one of the slide members of the slides. The slides are supported by a cross-bar of the wire frame. As illustrated in FIG. 16, a forward hook 2406 couples each slide to a cross-bar near a forward portion of the wire frame, and a rear hook 2408 couples each slide to a rear portion of the cross-bar of the wire frame. To provide further fixation of the slide with respect to the cross-bar, a ledge 2410 extends from the slide underneath the cross-bar. In one embodiment, and as illustrated in FIG. 16, the ledge is approximate a rear post of wire frame and includes a cut-out portion 2412 adapted to receive a vertical post of the wire frame. The hooks, therefore, support the slide and the oven rack on the cross-bar, with the ledge providing further support. In particular, as the slides and oven rack are extended, the weight of the extended slides and oven rack could cause the slides and rack to tilt forward. The ledge, however, serves to prevent upward motion of the rear of the rack and slide structure, thereby safely maintaining the rack in position.

Figure 17:
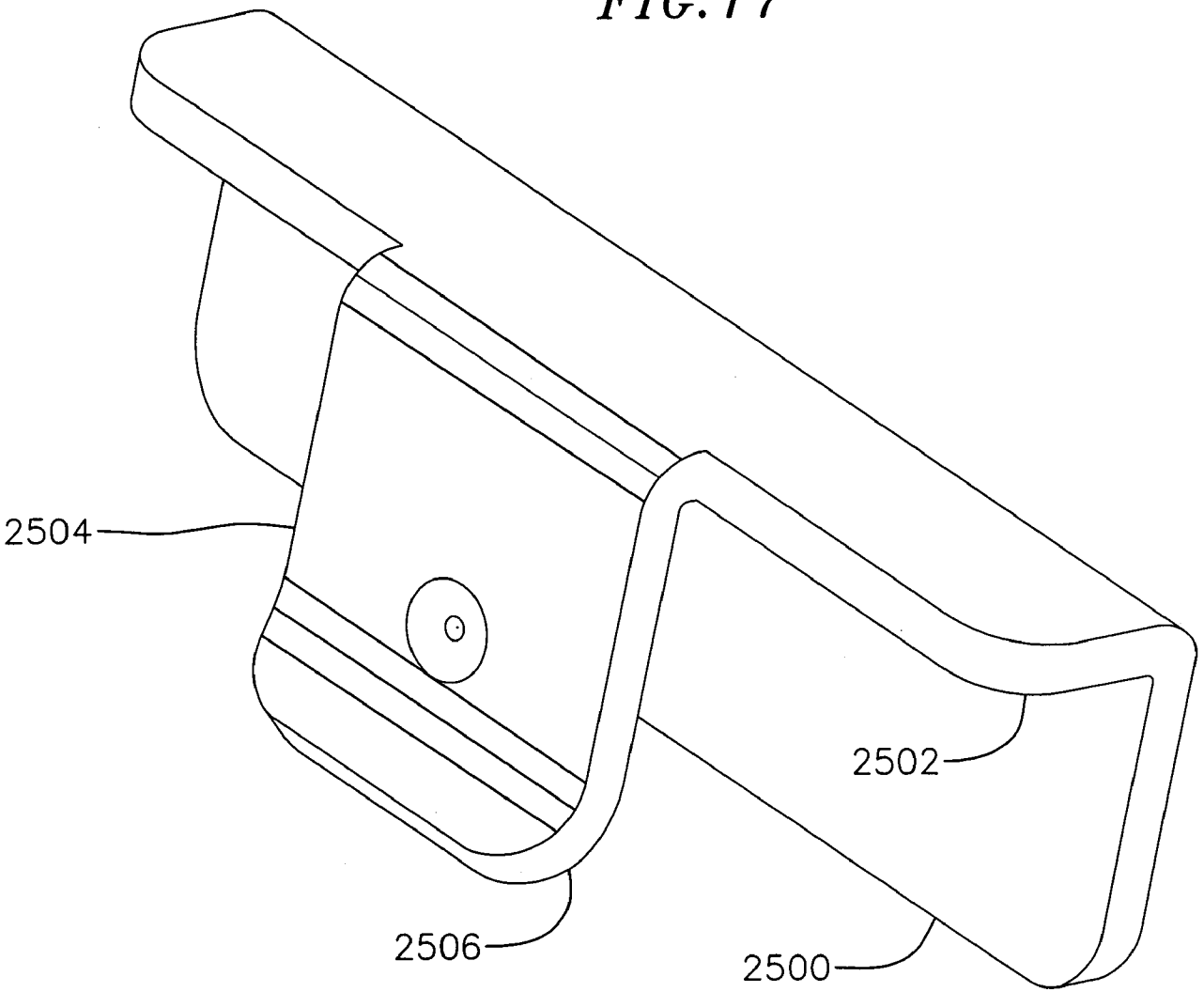
FIG. 17 illustrates a clip used to mount a slide to a wire rack.

FIG. 17 illustrates a view of the forward hook of FIG. 16. As illustrated, the hook includes a planar portion 2500 adapted to be welded or otherwise affixed to the web of the slide member. A top portion 2502 extends from the planar portion, with the top portion and the planar portion forming the shape of an L-bracket. A front 2504 of the hook is formed of a tab extending downward from the top portion with the front of the hook largely parallel to the planar section. In some embodiments, the front of the hook includes a outwardly bent leading edge 2506 curved away from the planar portion, providing for easier insertion of a cross-beam into the hook.

Figure 18:
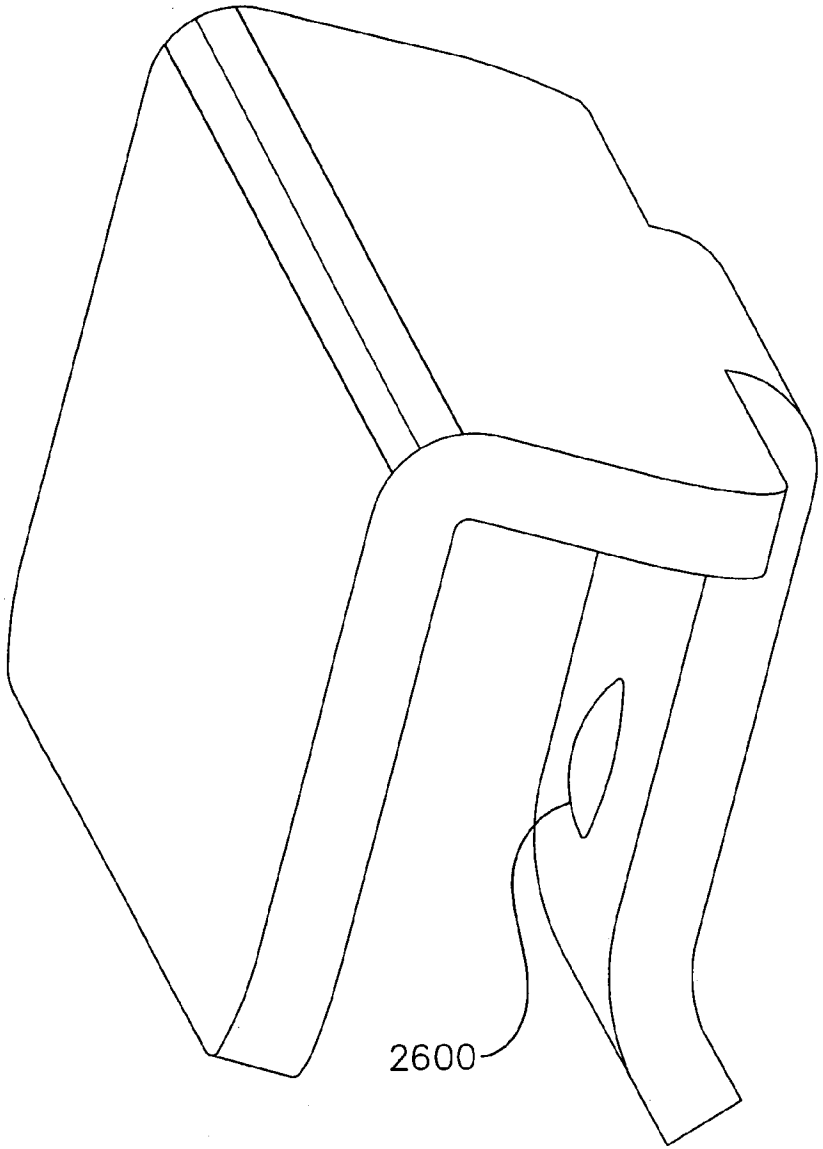
FIG. 18 illustrates a further view of the clip of FIG. 17.

FIG. 18 illustrates a further view of the hook of FIG. 17. As illustrated in FIG. 18, the inner portion of the front of the hook is illustrated, including a protrusion 2600 extending into the space between the planar portion and the front of the hook. The protrusion, which may be formed by embossing the front of the hook, serves to act as a frictional interface or detent to maintain a cross-bar within the hook and provide a snapping insertion feature.

Figure 19:
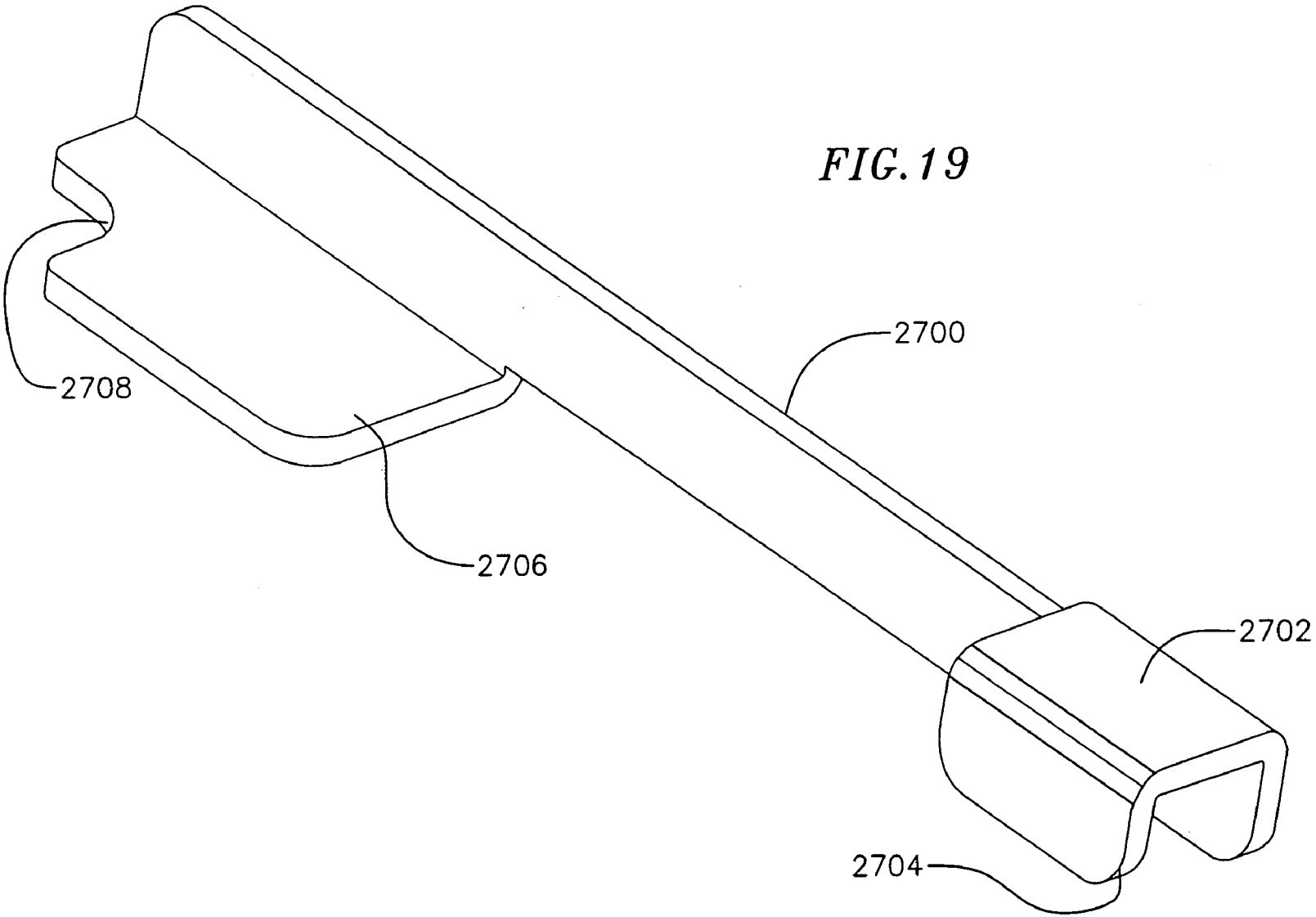
FIG. 19 illustrates a further clip used to mount a slide to a wire rack.

FIG. 19 illustrates a view of the rear hook of FIG. 16. As illustrated, the hook includes a planar portion 2700 adapted to be welded or otherwise affixed to the web of the slide member. The planar portion as illustrated in FIG. 16 is a largely rectangular elongate plate. A top portion 2702 extends from a portion of the planar portion, with the top portion and the planar portion forming a shape of an L bracket. As illustrated in FIG. 19, the top portion is approximate a forward edge of the planar portion, which is elongate in shape. Accordingly, the L bracket formed by the top portion and the planar portion is only towards the front of the planar portion. A forward edge 2704 hangs from the top portion, with the forward edge substantially parallel to the planar portion. The forward edge, top portion, and planar portion forming a U shaped channel. The U shaped channel is adapted to receive a cross-bar of a wire frame.

A ledge 2706 extends from the rear of the planar portion. The ledge extends in the same direction as the top portion, and with the top portion being viewed as extending from an upper front edge of the planar portion, the ledge extends from the lower rear of the planar portion. A forward edge of the ledge includes a cut-out 2708. The cut-out is adapted to receive a vertical post of the wire frame.

Figure 20:
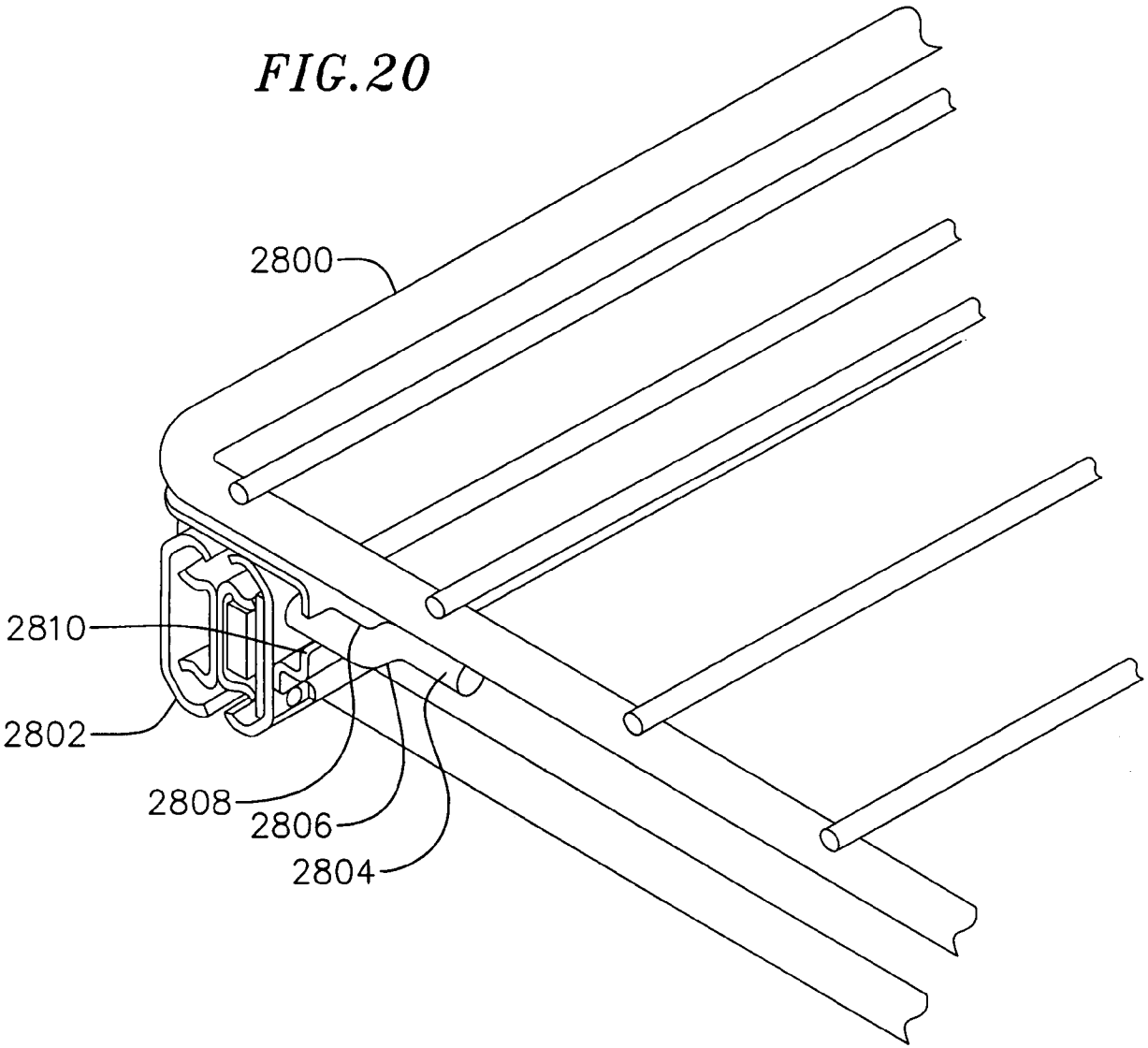
FIG. 20 illustrates a further system for connecting an oven rack to a slide assembly.

FIG. 20 illustrates a view of mechanism for coupling an oven rack to a slide member. As illustrated in FIG. 20, an oven rack 2800 is coupled to a side-by-side slide 2802. A forward bar of the oven rack has a mounting S-bar 2806 coupled to it. The mounting S-bar includes a mounting portion 2804 welded to the bottom of the oven rack. An offset bar 2808 is coupled to the mounting portion through a bend. The offset portion is substantially parallel to a forward edge of the oven rack. S-bars are mounted to the forward bar approximate slide members of both slides. Similarly, S-bars are also mounted to a rear bar of the oven rack.

The offset portion is sized to fit in a receiver 2810 coupled to the slide member. The receiver, as illustrated in FIG. 20 is substantially a U shaped cut-out or receiver, in a bracket attached to a web of the slide member. The bracket extends substantially along the length of the slide member, with a corresponding U shaped cut-out, or receiver, a the rear of the bracket. The cut-out at the rear of the bracket faces in the opposing direction, namely rearwardly, compared to the cut-out at the front of the bracket.

Figure 21:
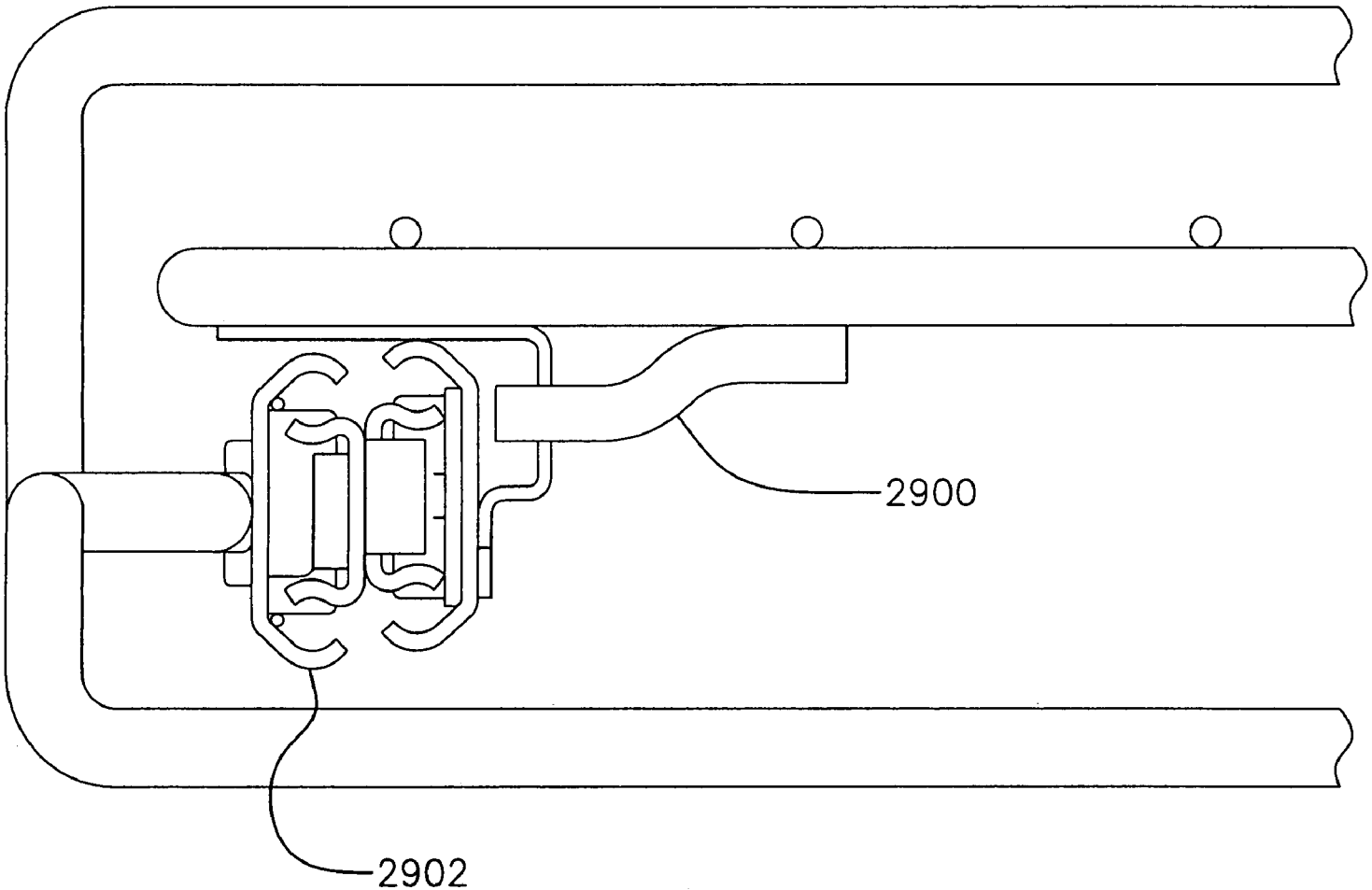
FIG. 21 illustrates a front view of the system of FIG. 20.

FIG. 21 illustrates a further view of the mechanism of FIG. 20. As illustrated in FIG. 21, an S-bar is adapted to be coupled to a side by side slide 2902 by way of a receiving bracket 2904. The receiving bracket is somewhat U shaped, with a mounting flange extending from the U shape. The mounting flange is adapted to be welded or otherwise attached to the web of the slide member. The U shape includes a notch or receiver, on one side adapted to receive the offset bar.

Figure 22:
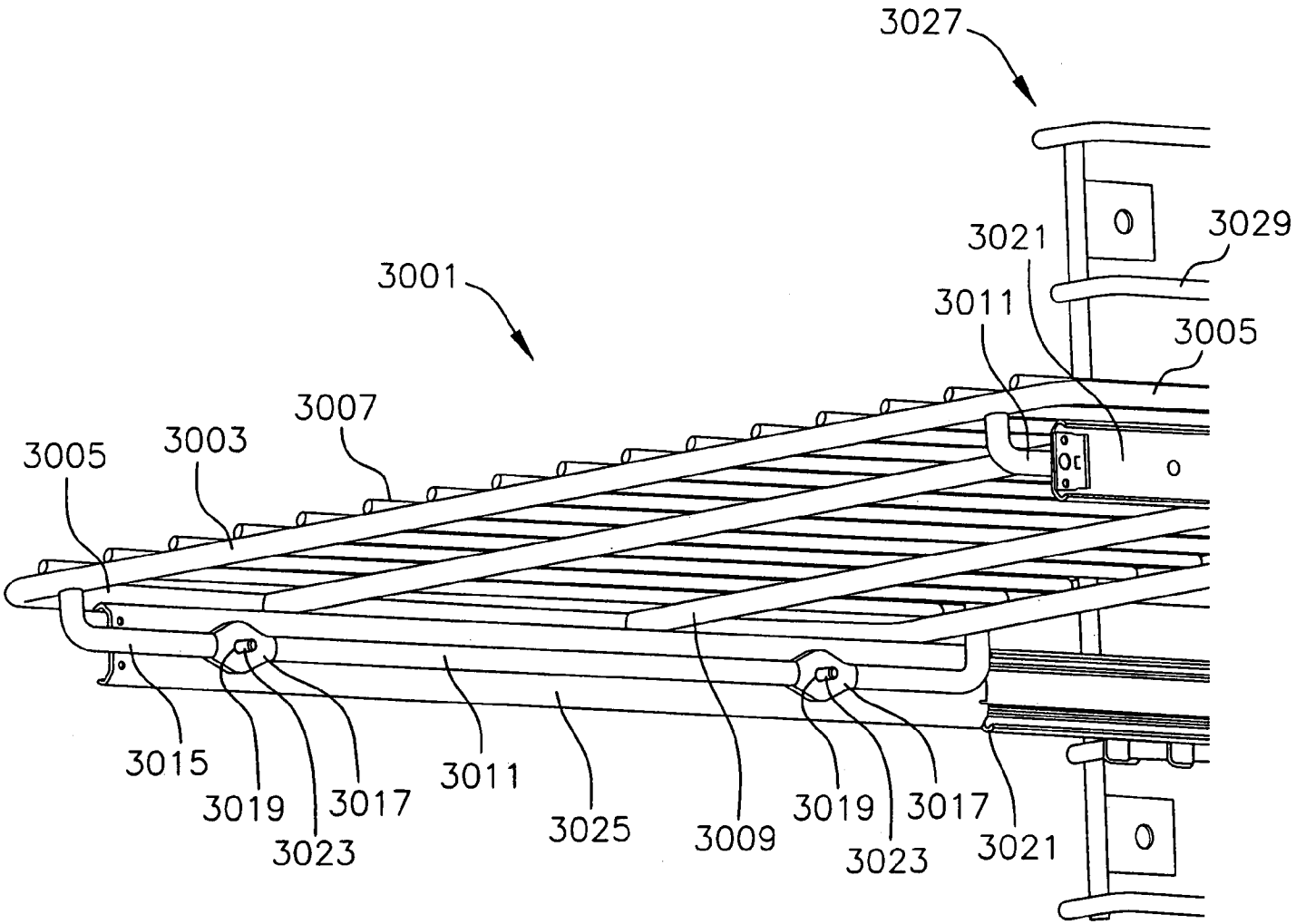
FIG. 22 illustrates an oven rack with two mounting point attachments to a slide assembly in accordance with aspects of the invention.

FIG. 22 illustrates an oven rack assembly in accordance with an embodiment of the invention. The oven rack assembly includes an oven rack 3001. The oven rack includes a forward bar 3003 and a rear bar (not shown) connected by side bars 3005. As illustrated, rack bars 3007 adapted to support items for cooking extend from the forward bar to the rear bar, with the rack bars additionally supported by support bars 3009. The rack bars form a support surface. The oven rack includes subtending mounting bars 3011. The mounting bars are each attached to the oven rack approximate the oven rack side bars, largely underneath the rack bars. The mounting bars include two off-set portions 3013 which extend downward from the front and rear bar. The off-set portions are connected by a longitudinal mounting bar 3015. The longitudinal mounting bar includes flattened portions 3017 including apertures 3019. The apertures are dimensioned for reception of mounting posts. Placement of mounting post in the aperture provides secure support for the oven rack.

A pair of slide assemblies 3021 are coupled to the oven rack approximate the side bars. As illustrated, the slides are full extension side-by-side slides. In other embodiments, other types of slides are used. Discussing one of the slide assemblies as an example, the slide is shown in an extended position. Two posts 3023 extend from a web 3025 of the extending slide. The posts may be screws extending through the web of the slide member. In some embodiments the posts are rivets extending through the web of the slide member or other protruding structures, and may include threaded ends for use of a nut to securely hold the mounting bar to the slide. The posts are adapted to provide two point mounting for an oven rack.

The slide assembly is supportably mounted to a support frame 3027. The support frame is formed of a wire frame with vertically spaced cross-bars 3029, and configured to be placed adjacent a side wall of an oven. A corresponding further support frame (not shown) is positioned approximate an opposing side wall of the oven.

Figure 23:
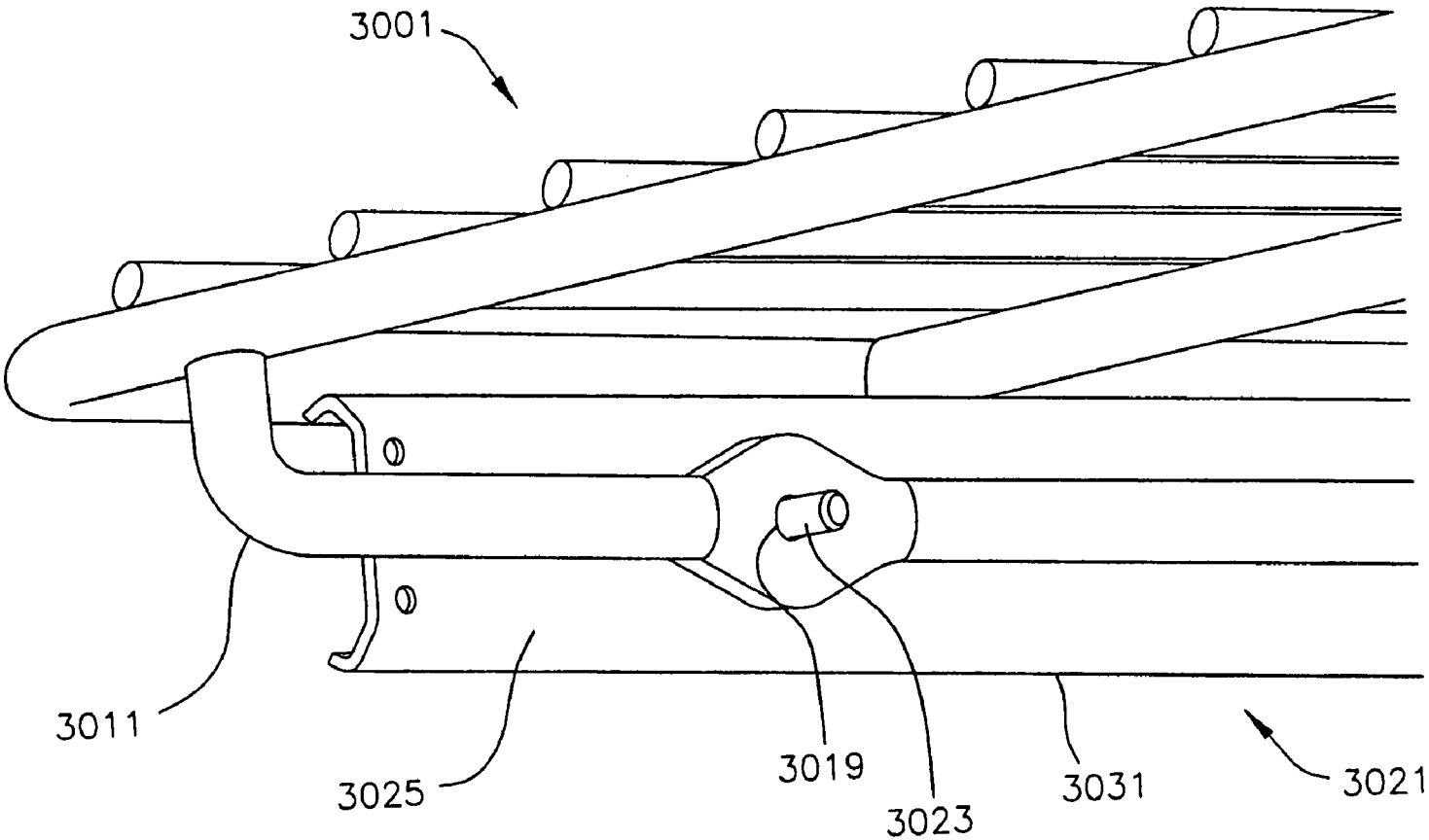
FIG. 23 illustrates a view of a mounting pivot of FIG. 22.

FIG. 23 illustrates the close-up view of one of the mounting points of the assembly of FIG. 22. As illustrated in FIG. 23, a mounting bar 3011 subtends from an oven rack 3001. The oven rack extends over and past a slide member 3031 of a slide assembly 3021. A mounting post 3023 extends from a web 3025 of one of the slide members. The mounting post passes through an aperture 3019 in the mounting bar. The aperture is located in the flattened portion of the mounting bar.

Accordingly, the present invention provides a rack assembly for an oven and an oven with a rack assembly. Although the invention has been described in certain embodiments, the scope of the invention should be measured by the claims and their equivalents supported by this description.

What is claimed is:

1. An oven assembly with an extendable rack, comprising:

the oven rack including a pair of laterally spaced subtending bars, the subtending bars including two mounting points;

a pair of extendable slide assemblies, each slide assembly coupled to a corresponding subtending bar at the two mounting points;

wherein each of the extendable slide assemblies includes a slide rail having a longitudinal web, the longitudinal webs being coupled to the subtending bar at the two mounting points;

wherein the mounting points each comprise an aperture in the subtending bars, and further comprising mounting posts extending from the longitudinal webs, with a mounting post for each mounting point, the mounting posts each extending into a corresponding aperture in the subtending bars.

2. The oven assembly of claim 1 wherein each slide assembly is a full extension slide.

3. The oven assembly of claim 2 wherein each slide assembly is a side-by-side slide.

4. An assembly with an extendable rack for an oven, comprising:

opposing wire frames positioned approximate opposing lateral margins of the oven rack;

a pair of extendable slide assemblies, each slide assembly including a first longitudinal member supported by a corresponding wire frame and at least a second longitudinal member longitudinally extendable relative to the first longitudinal member;

the oven rack including an oven rack support surface adapted to have placed thereon items for cooking in an oven, the oven rack including a pair of longitudinal mounting bars approximate longitudinal edges of the oven rack support surface;

wherein each mounting bar is attached to the second longitudinal member of a corresponding extendable slide assembly at a plurality of mounting points between a front end and a rear end of the mounting bar;

wherein each slide assembly is supported by a cross-bar of the corresponding wire frame; and wherein a forward hook couples each slide assembly to the cross-bar near a forward portion of the corresponding wire frame and wherein a rear hook couples each slide assembly to the cross-bar near a rear portion of the corresponding wire frame.

5. The assembly of claim 4, further comprising means for preventing upward motion of a rear of the slide assemblies.

* * * * *